US009180660B2

(12) United States Patent
Oikawa et al.

(10) Patent No.: US 9,180,660 B2
(45) Date of Patent: Nov. 10, 2015

(54) INK JET RECORDING APPARATUS

(71) Applicant: CANON KABUSHIKI KAISHA, Tokyo (JP)

(72) Inventors: Yuhei Oikawa, Yokohama (JP); Kazuo Suzuki, Yokohama (JP); Hiroaki Shirakawa, Kawasaki (JP); Mitsutoshi Nagamura, Tokyo (JP); Yosuke Ishii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/712,890

(22) Filed: Dec. 12, 2012

(65) Prior Publication Data

US 2013/0147868 A1 Jun. 13, 2013

(30) Foreign Application Priority Data

Dec. 13, 2011 (JP) ..... 2011-272758

(51) Int. Cl.
*B41J 29/38* (2006.01)
*B41J 2/045* (2006.01)

(52) U.S. Cl.
CPC ..... *B41J 2/0454* (2013.01); *B41J 2/0458* (2013.01); *B41J 2/0459* (2013.01); *B41J 2/04563* (2013.01); *B41J 2/04588* (2013.01); *B41J 2/04591* (2013.01); *B41J 2/04598* (2013.01)

(58) Field of Classification Search
CPC ..... B41J 2/04598
See application file for complete search history.

(56) References Cited

U.S. PATENT DOCUMENTS

| | | | | |
|---|---|---|---|---|
| 6,331,039 | B1 * | 12/2001 | Iwasaki et al. | 347/11 |
| 2003/0156147 | A1 * | 8/2003 | Misumi | 347/17 |
| 2006/0250465 | A1 * | 11/2006 | Anderson et al. | 347/102 |
| 2008/0079765 | A1 * | 4/2008 | Takamiya et al. | 347/19 |
| 2008/0143775 | A1 * | 6/2008 | Shihoh et al. | 347/17 |
| 2009/0040257 | A1 * | 2/2009 | Bergstedt et al. | 347/17 |
| 2010/0165029 | A1 * | 7/2010 | Gibson et al. | 347/14 |

FOREIGN PATENT DOCUMENTS

JP 5-31905 A 2/1993

* cited by examiner

*Primary Examiner* — Shelby Fidler
(74) *Attorney, Agent, or Firm* — Canon USA Inc. IP Division

(57) ABSTRACT

The present invention relates to an ink jet recording apparatus including a recording head including a plurality of energy generation elements configured to generate thermal energy. The ink jet recording apparatus includes a specification unit and a control unit. The specification unit specifies a pulse width upper limit value of a prepulse during a recording operation based on a minimum pulse width by which ink is discharged by applying a drive pulse to the energy generation elements and a temperature of the recording head during the recording operation. The control unit controls the energy generation elements to be driven using a drive pulse of a prepulse with a pulse width equal to or less than the pulse width upper limit value.

25 Claims, 23 Drawing Sheets

| DRIVE PULSE No. [N] | DRIVE PULSE WAVEFORM |
|---|---|
| No. 0 |   P1:0.48 μs<br>P2:0.30 μs<br>P3:0.08 μs |
| No. 1 |   P1:0.40 μs<br>P2:0.30 μs<br>P3:0.16 μs |
| No. 2 |   P1:0.32 μs<br>P2:0.30 μs<br>P3:0.24 μs |
| No. 3 |   P1:0.24 μs<br>P2:0.30 μs<br>P3:0.32 μs |
| No. 4 |   P1:0.16 μs<br>P2:0.30 μs<br>P3:0.40 μs |
| No. 5 |   P1:0.08 μs<br>P2:0.30 μs<br>P3:0.48 μs |
| No. 6 |   P1:0 μs<br>P2:0 μs<br>P3:0.56 μs |

FIG. 10A

| | | HEAD TEMPERATURE (°C) | | | | | |
|---|---|---|---|---|---|---|---|
| | | 30 OR GREATER AND LESS THAN 35 | 35 OR GREATER AND LESS THAN 40 | 40 OR GREATER AND LESS THAN 45 | 45 OR GREATER AND LESS THAN 50 | 50 OR GREATER AND LESS THAN 55 | 55 OR GREATER AND LESS THAN 60 |
| THRESHOLD VALUE (μs) | 0.30 OR GREATER AND LESS THAN 0.35 | 0.29 | 0.26 | 0.23 | 0.2 | 0.17 | 0.14 |
| | 0.35 OR GREATER AND LESS THAN 0.40 | 0.34 | 0.31 | 0.34 | 0.31 | 0.34 | 0.31 |
| | 0.40 OR GREATER AND LESS THAN 0.45 | 0.39 | 0.36 | 0.33 | 0.3 | 0.27 | 0.24 |
| | 0.45 OR GREATER AND LESS THAN 0.50 | 0.44 | 0.41 | 0.38 | 0.35 | 0.32 | 0.29 |

FIG. 10C

<1>

| HEAD TEMPERATURE (°C) | 30 OR GREATER AND LESS THAN 35 | 35 OR GREATER AND LESS THAN 40 | 40 OR GREATER AND LESS THAN 45 | 45 OR GREATER AND LESS THAN 50 | 50 OR GREATER AND LESS THAN 55 | 55 OR GREATER AND LESS THAN 60 |
|---|---|---|---|---|---|---|
| DRIVE PULSE No | No. 1 | No. 2 | No. 3 | No. 4 | No. 5 | No. 6 |

<2>

| HEAD TEMPERATURE (°C) | 40 OR GREATER AND LESS THAN 45 | 45 OR GREATER AND LESS THAN 50 | 50 OR GREATER AND LESS THAN 55 | 55 OR GREATER AND LESS THAN 60 | 60 OR GREATER AND LESS THAN 65 |
|---|---|---|---|---|---|
| DRIVE PULSE No | No. 2 | No. 3 | No. 4 | No. 5 | No. 6 |

<3>

| HEAD TEMPERATURE (°C) | 50 OR GREATER AND LESS THAN 55 | 55 OR GREATER AND LESS THAN 60 | 60 OR GREATER AND LESS THAN 65 | 65 OR GREATER AND LESS THAN 70 |
|---|---|---|---|---|
| DRIVE PULSE No | No. 3 | No. 4 | No. 5 | No. 6 |

FIG. 12C

| ACCUMULATED DISCHARGE NUMBER FROM DETECTION OF DISCHARGE THRESHOLD VALUE (dot/NOZZLE) | WEIGHTING COEFFICIENT TO PREPULSE UPPER LIMIT VALUE |
|---|---|
| 1E+7 | 1.2 |
| 2E+7 | 1.18 |
| 3E+7 | 1.13 |
| 4E+7 | 1.05 |

| RECORDING DUTY (%) | WEIGHTING COEFFICIENT TO PREPULSE UPPER LIMIT VALUE |
|---|---|
| 0～20 | 1.4 |
| 20～40 | 1.3 |
| 40～60 | 1.2 |
| 60～80 | 1.1 |
| 80～100 | 1.0 |

FIG. 14B

| INK KIND | OFFSET AMOUNT TO DISCHARGE THRESHOLD VALUE (μs) |
|---|---|
| Cyan | -0.05 |
| Magenta | -0.05 |
| Yellow | -0.03 |
| Black | -0.09 |

INK JET RECORDING APPARATUS

BACKGROUND OF THE INVENTION

1. Field of the Invention

The present invention relates to an ink jet recording apparatus configured to discharge ink onto a recording medium to perform recording.

2. Description of the Related Art

A thermal ink jet recording apparatus repeats an operation for scanning a recording medium such as paper with a recording head having a discharge port for discharging ink, and a conveying operation for conveying the recording medium in a direction crossing a direction in which scan is performed with the recording head, to form an image. Thermal energy generated by an energy generation element (hereinafter, also referred to as a heater) provided so as to correspond to the discharge port causes film boiling of the ink. The ink is discharged from the discharge port by pressure of air bubbles produced in this case, and thereby the ink impacts on the recording medium.

It is known that the discharge amount of the discharged ink varies depending on the temperature of the recording head because viscosity and surface tension of the ink used for a recording operation vary with a temperature. Specifically, following phenomenon arises. In the phenomenon, when the temperature of the recording head rises, the discharge amount of the ink increases, and conversely, when the temperature of the recording head decreases, the discharge amount of the ink decreases.

When the variations in the discharge amount of the ink are caused, density unevenness is caused on the recording medium to reduce image quality. Therefore, a technique is used, which performs drive pulse width control for controlling a pulse width of a drive pulse (double pulse) including a prepulse and a main pulse supplied to the energy generation element to keep the discharge amount of the ink in a constant range. The prepulse supplies energy to the ink to a degree that the ink does not foam, to preparatorily heat the ink. The main pulse supplies energy to the ink to a degree that the ink foams. The prepulse and the main pulse are continuously applied, and thereby a droplet of the ink is discharged.

Japanese Patent Application Laid-Open No. 5-31905 discusses the following method. The method reads fluctuation of a temperature of a recording head by means of a temperature sensor, selects a drive pulse based on the temperature of the recording head from a drive pulse table storing a plurality of drive pulses, and sets the discharge amount of ink to a constant range. The drive pulse table stores the drive pulses in which pulse widths of prepulses are mutually different, of a double pulse applied to an energy generation element. A prepulse with a narrower pulse width is selected as the temperature of the recording head rises. All the pulse widths of the prepulses in a conventional technique such as Japanese Patent Application Laid-Open No. 5-31905 are set to a range in which the ink does not foam even when the recording head is in any condition.

A range in which the temperature of the recording head fluctuates during the recording operation can be extended along with recent speedup of recording and high density of the discharge port of the recording head. Thereby, it is required to extend a temperature range of temperature ranges T0 to TL of a head in which discharge amount control can be performed by pulse width modulation. Therefore, use of the drive pulse table including the drive pulse of the prepulse which is not used in Japanese Patent Application Laid-Open No. 5-31905 is considered.

However, an energy amount of a boundary at which the foaming of the ink is started easily fluctuates under the influence of the fluctuation of the temperature of the recording head and the fluctuation with time of the discharge characteristic of the recording head, or the like. Therefore, there is concern that when the prepulse is applied, a liquid minutely foams (a state immediately before the film boiling) depending on the state of the recording head during the recording operation. If the main pulse is applied onto the energy generation element before the air bubbles produced by minute foams are defoamed, normal film boiling does not generated when the main pulse is applied under the influence of the air bubbles, so that the discharge of the ink becomes unstable.

SUMMARY OF THE INVENTION

According to an aspect of the present invention, an ink jet recording apparatus includes a recording head including a plurality of energy generation elements configured to generate thermal energy for discharging ink by applying a drive pulse, a temperature detection unit configured to detect a temperature of the recording head, an acquisition unit configured to acquire a minimum pulse width by which the ink is discharged when the minimum pulse width is applied to the energy generation elements, a specification unit configured to specify a pulse width upper limit value of a prepulse during a recording operation based on the minimum pulse width acquired by the acquisition unit and the temperature of the recording head during the recording operation, and a control unit configured to control the energy generation elements to be driven using a drive pulse of a prepulse with a pulse width equal to or less than the pulse width upper limit value.

The ink jet recording apparatus can perform control so as not to generate minute foams upon application of a main pulse of the drive pulse of the energy generation element. Thereby, the generation of the minute foams on the energy generation element can be prevented, and a stable discharge operation can be performed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute apart of the specification, illustrate exemplary embodiments, features, and aspects of the invention and, together with the description, serve to explain the principles of the invention.

FIGS. 10A, 10B, and 10C illustrate a prepulse upper limit value.

FIGS. 12A, 12B, and 12C illustrate control of a third exemplary embodiment.

FIGS. 14A and 14B illustrate control of a fifth exemplary embodiment.

DESCRIPTION OF THE EMBODIMENTS

Various exemplary embodiments, features, and aspects of the invention will be described in detail below with reference to the drawings.

An ink jet recording apparatus can be used to discharge ink to perform a recording operation to a recording medium. Specific examples of application apparatus include business machines such as a printer, a copying machine, and a facsimile, and an industrial production apparatus. The use of the ink jet recording apparatus enables to perform recording on various recording media such as paper, thread, fiber, cloth, leather, metal, plastic, glass, wood, and ceramic.

The term "recording" used in this specification refers to not only applying an image, which has a meaning, such as a character or a shape onto a recording medium, but also applying an image, which has no meaning, such as a pattern onto a recording medium.

Furthermore, the term "ink" should be widely interpreted. The ink refers to any liquid used to form an image, a design, or a pattern or the like, used to process a recording medium, or used to process ink or a recording medium by being applied onto a recoding medium.

Hereinafter, exemplary embodiments of the present invention will be described with reference to the drawings. In the description below, where configurations are identical in function, the configurations are labeled with an identical reference number illustrated in a corresponding drawing, and the description thereof may be omitted.

Figure 1A:
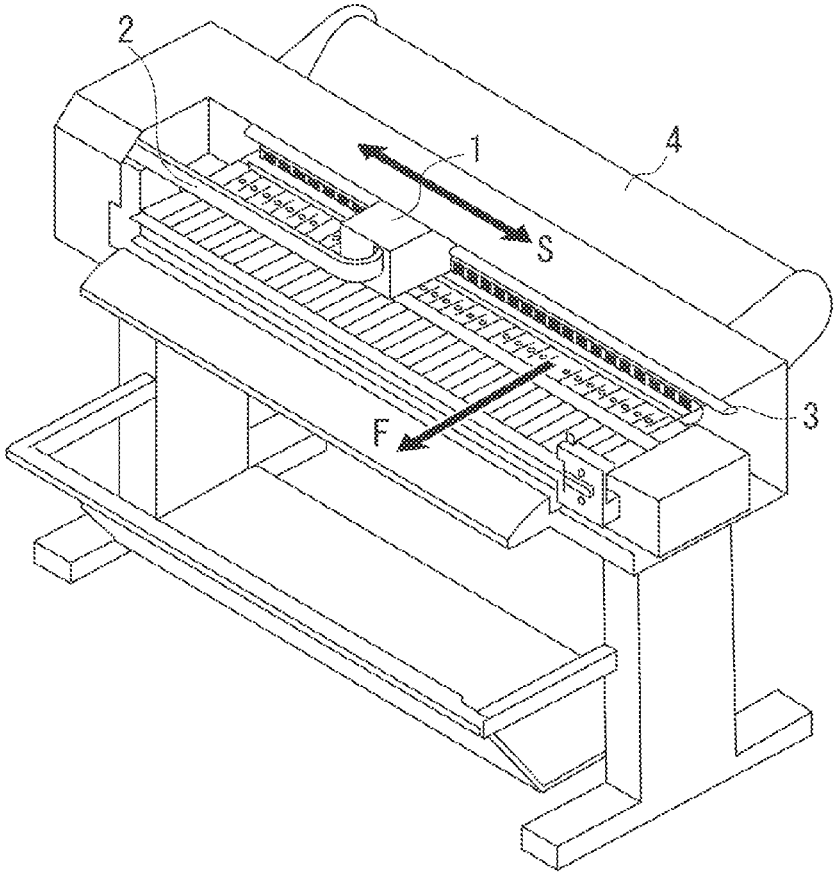
FIGS. 1A, 1B, and 1C are schematic views of an ink jet recording apparatus and a recording head according to the present invention.

FIG. 1A is a schematic perspective view illustrating an internal mechanism of an ink jet recording apparatus which can be applied to the present exemplary embodiment.

A conveyance motor (not illustrated) drives to convey a recording medium 4 in the direction (sub-scanning direction) of arrow F (conveyance operation). A guide shaft 3 is arranged in parallel with the surface of the recording medium 4 along a direction orthogonal to the conveyance direction F (sub-scanning direction) of the recording medium 4. A carriage 1 (scanning unit) on which a recording head 5 is mounted is driven by a carriage motor (not illustrated) to move in a reciprocating motion (reciprocating scan) in the direction indicated by arrow S in FIG. 1A (main scanning direction) while being supported by the guide shaft 3. An ink tank (not illustrated) is provided in the ink jet recording apparatus. The ink is supplied to the recording head 5 via an ink supply path 2.

While the carriage 1 performs the reciprocating scan, the recording head 5 discharges the ink according to recording data to perform recording on the recording medium 4 (recording operation). An image is formed on the recording medium 4 by repeating the recording operation and the conveyance operation. The present exemplary embodiment employs a bidirectional recording method in which recording is performed on the recording medium 4 by discharging the ink when the recording head 5 moves along its forward path and when it moves along its backward path. After a scan along with one recording is performed by the recording head 5, the recording medium 4 is conveyed by a predetermined amount by the conveyance motor (not illustrated).

Figure 1B:
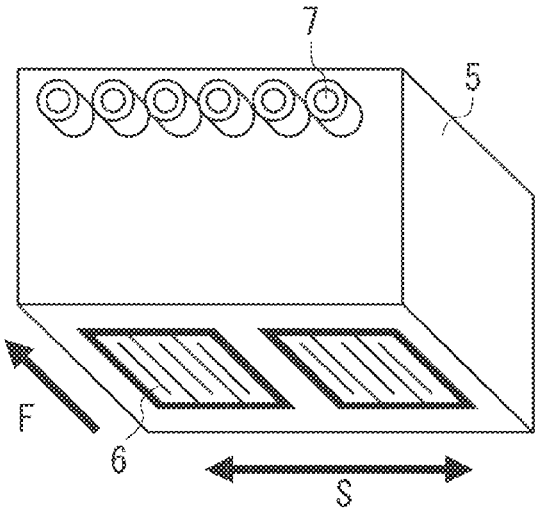
Figure 1C:
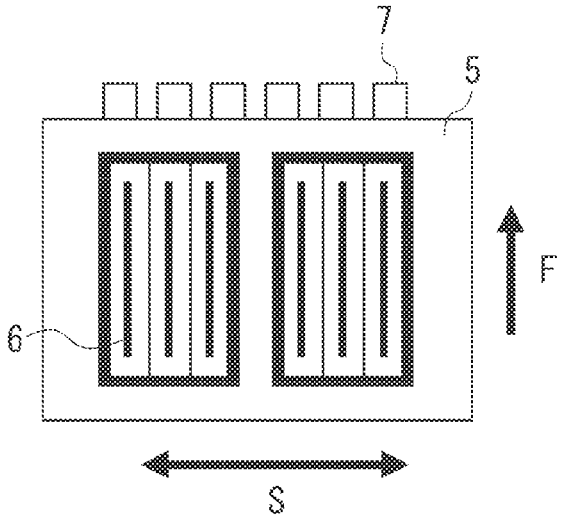
Figure 2A:
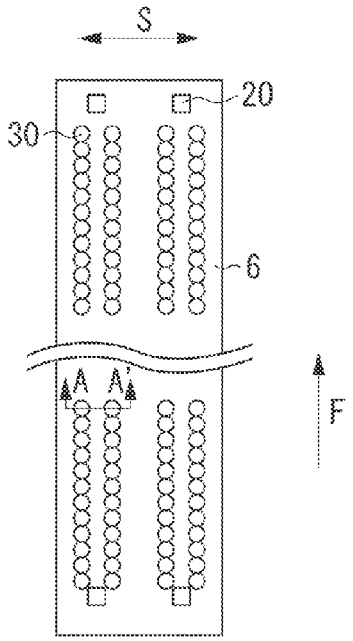
FIGS. 2A, 2B, and 2C are a schematic plan view and a schematic cross sectional view of a recording head substrate according to the present invention.

FIG. 1B is a schematic perspective view of the recording head 5 mounted on the carriage 1 of the ink jet recording apparatus illustrated in FIG. 1A. FIG. 1C is a schematic view of a discharge port forming surface which is a surface of the recording head 5 facing the recording medium 4. FIG. 2A is a schematic view of an upper surface of a recording head substrate 6 mounted on the recording head 5.

Six recording head substrates 6 are mounted on the recording head 5 to perform a recording operation using six kinds of inks. As illustrated in FIG. 2A, each of the recording head substrates 6 includes a plurality of discharge ports arranged along the sub-scanning direction. The discharge ports form four discharge port rows. Specifically, four rows of 640 discharge ports arranged at 600 dpi (dot/inch) are provided. The two adjacent rows are arranged in a direction deviated by 1200 dpi. A plurality of temperature detection sensors 20 configured to measure a temperature of the recording head substrates 6 are provided on each of the recording head substrate 6. Hereinafter, the temperature of each of the recording head substrates measured by the temperature detection sensors 20 is also referred to as a head temperature.

Figure 2B:
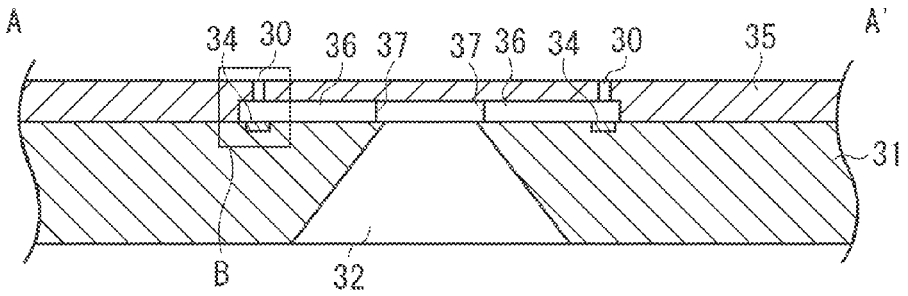
Figure 2C:
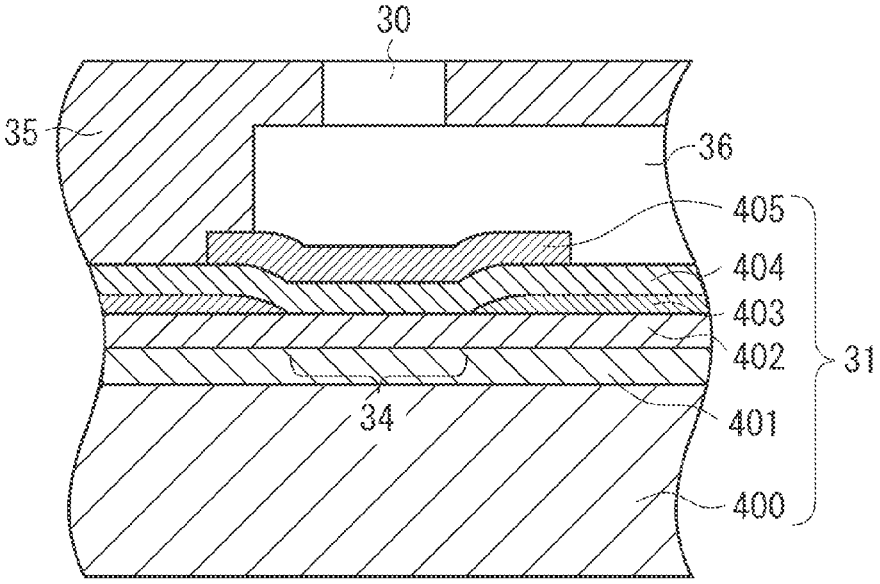

FIG. 2B is a cross sectional view schematically illustrating a state of a cut surface of the recording head substrate of FIG. 2A vertically cut along A-A'. FIG. 2C is an enlarged view of an energy generation element 34 of FIG. 2B.

A thermal accumulation layer 401, a heat generating material layer 402, and a pair of electrode layers 403 are laminated on a silicon substrate 400 having a drive element such as a transistor provided thereon. The thermal accumulation layer 401 may be provided by an insulating material primarily including silicon. The heat generating material layer 402 may be provided by a material such as TaSiN, which generates heat by being energized. The pair of electrode layers 403 may be provided by aluminum or the like constituting an electrode for energizing. A portion of the heat generating material layer 402 located between the pair of electrode layers 403 is used as the energy generation element 34.

An insulating layer 404 made of an insulating material primarily including silicon is laminated on the heat generating material layer 402 and the pair of electrode layers 403, thereby protecting the energy generation element 34 from the ink or the like. Furthermore, a protection layer 405 made of a metal material such as Ta is provided on the insulating layer 404 corresponding to the energy generation element 34 to protect the energy generation element 34 from cavitation produced when air bubbles are defoamed.

A channel member 35 having a discharge port 30 corresponding to each of the energy generation elements 34 is provided in contact with a base 31. Furthermore, the channel member 35 and the base 31 are in contact with each other, and thereby a channel 36 communicating with each of the discharge port 30 is formed between the channel member 35 and the base 31. A partition wall 37 is formed between the adjacent channels 36.

The ink supplied to the recording head 5 through a joint portion 7 from the ink supply path 2 of the ink jet recording apparatus is carried to an ink supply port 32 of the recording head substrate 6 through the inside of the recording head 5. The ink is carried to the upper side of the energy generation element 34 through the channel 36.

Furthermore, the energy generation element 34 of the recording head 5 is driven by a recording signal received from the ink jet recording apparatus, to apply a drive pulse to the energy generation element 34, and thereby the energy generation element 34 generates heat by being energized. The thermal energy causes film boiling of the ink on the energy generation element 34 to cause the ink foams. The ink is discharged from the discharge port 30 by the pressure of the air bubbles produced at this time to perform the recording operation.

Figure 3:
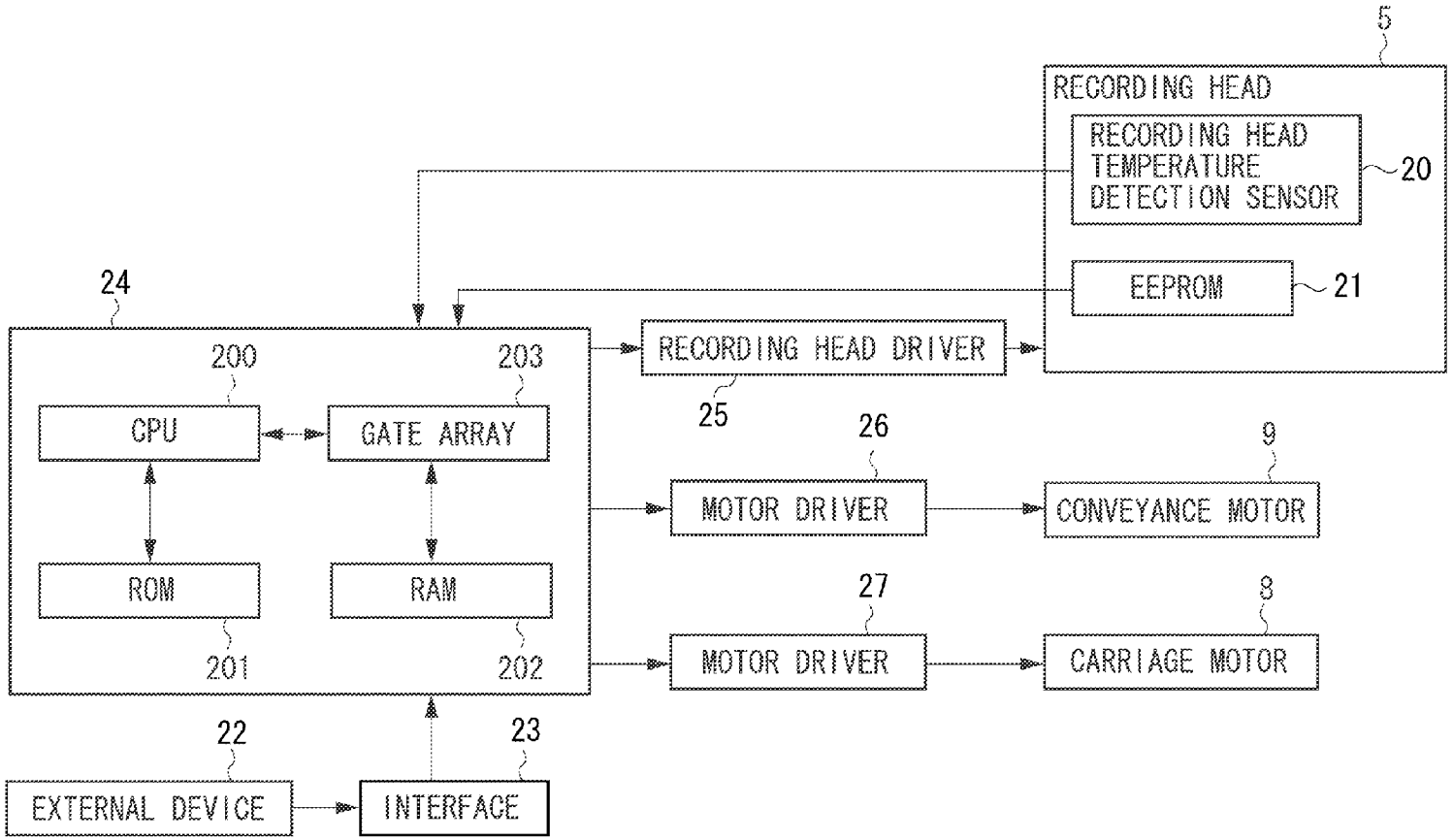
FIG. 3 is a block diagram illustrating a control system of the ink jet recording apparatus according to the present invention.

FIG. 3 is a block diagram illustrating a control constitution of the ink jet recording apparatus.

A central processing unit (CPU) 200, a read only memory (ROM) 201, a random access memory (RAM) 202, and a gate array 203 are provided in a control system 24. The ROM 201 is used as a storing unit configured to store programs executed by the CPU 200. The ROM 201 may be used to store a drive pulse table for performing discharge control. The RAM 202 is a storing unit configured to be used to temporarily save various data (image data or the recording signal supplied to the recording head, or the like). The gate array 203 is used to supply the recording signal to the recording head 5. The gate array 203 is used also for data transfer among an interface 23, the CPU 200, and the RAM 202.

A motor driver 26 is used to drive a carriage motor 8 in order to move the recording head 5 to a predetermined recording position in the main scanning direction according to a signal output from the control system 24. Similarly, a recording head driver 25 drives the recording head 5 according to the recording signal output from the control system 24. The motor driver 26 drives a conveyance motor 9 according to the signal output from the control system 24 to perform the conveyance operation of the recording medium 4.

The recording head 5 includes a temperature detection sensor 20 configured to detect the temperature of the recording head 5 and an electrically erasable programmable read-only memory (EEPROM) 21 configured to store characteristics acquired at the inspection in a factory such as a discharge amount, and resistance of a heater element and a line.

The gate array 203 and the CPU 200 of the control system 24 convert the image data received from an external device 22 via the interface 23 to recording data, and stores the recording data in the RAM 202. Furthermore, the control system 24 drives the motor drivers 26 and 27 and the recording head driver 25 in synchronization to perform the recording operation of the recording head 5, the conveyance operation of the recording medium 4, and the reciprocating motion of the recording head 5 in the main scanning direction, thereby forming an image on the recording medium 4.

Figure 4A:
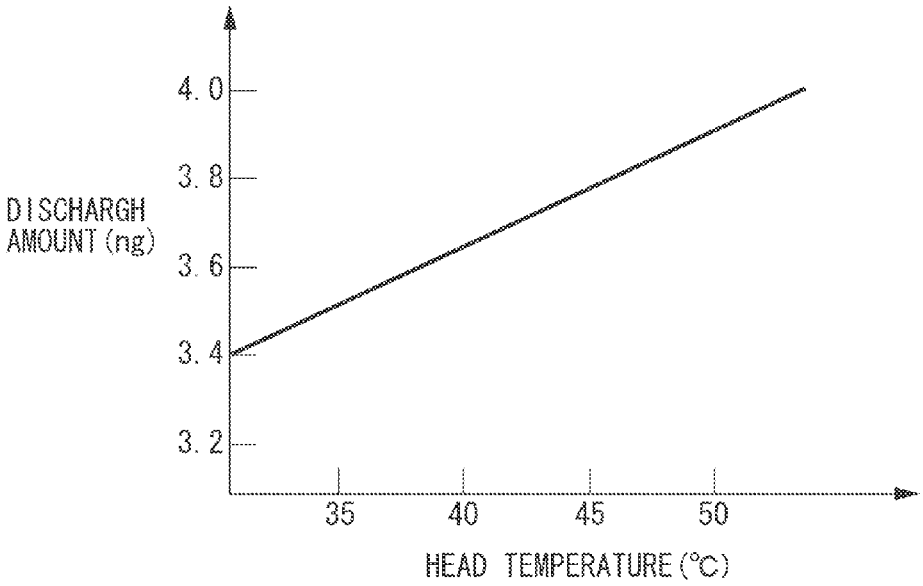
FIGS. 4A and 4B illustrate a relationship between a head temperature and an discharge amount and a relationship between a pulse width of a prepulse and the discharge amount.

Next, discharge amount control for keeping the discharge amount of the ink almost constant will be described. FIG. 4A is a graph illustrating the temperature dependence of the discharge amount of the ink when the drive pulse and a drive voltage are fixed. As is clear from FIG. 4A, it is found that the discharge amount of the ink increases because the viscosity of the ink rises or the surface tension of the ink varies as the temperature of the recording head rises.

Figure 5A:
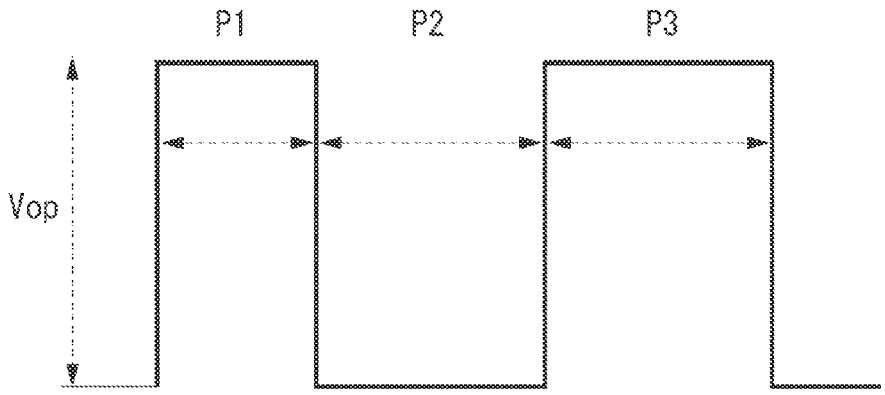
FIGS. 5A and 5B illustrate a drive pulse applied to drive an energy generation element.

FIG. 5A illustrates a double pulse of the drive pulses applied to the energy generation element 34. FIG. 5A illustrates a drive voltage Vop, a pulse width P1 of a first pulse (hereinafter, referred to as a prepulse) of a divided pulse, an interval time P2, and a pulse width P3 of a second pulse (hereinafter, referred to as a main pulse). Because The discharge control of the ink is performed by controlling the pulse width of the prepulse, so that the prepulse plays a significant role.

The prepulse is applied to mainly heat the ink in a channel to be likely to cause the foaming of the ink. The pulse width of the prepulse is set to a value equal to or less than a pulse width having energy smaller than an energy value of a boundary at which the ink foams. This is because a prefoaming phenomenon arises when the pulse width has energy exceeding the energy value of the boundary. The prefoaming phenomenon causes an unstable state of the ink in the channel, which complicates the control of the discharge amount. Here, the prefoaming phenomenon is that an unstable discharge state is caused by producing minute foams (a state immediately before the film boiling) on the energy generation element 34, applying the next main pulse before the air bubbles are defoamed, and the minute air bubbles disturbing the foaming caused by the main pulse.

The interval time P2 is a width of a predetermined period of time provided between the prepulse and the main pulse. The interval time P2 is provided so that the heat of the prepulse is sufficiently transmitted to the ink in the channel. The main pulse is used in order to cause the ink to foam to discharge droplets of the ink.

Figure 4B:
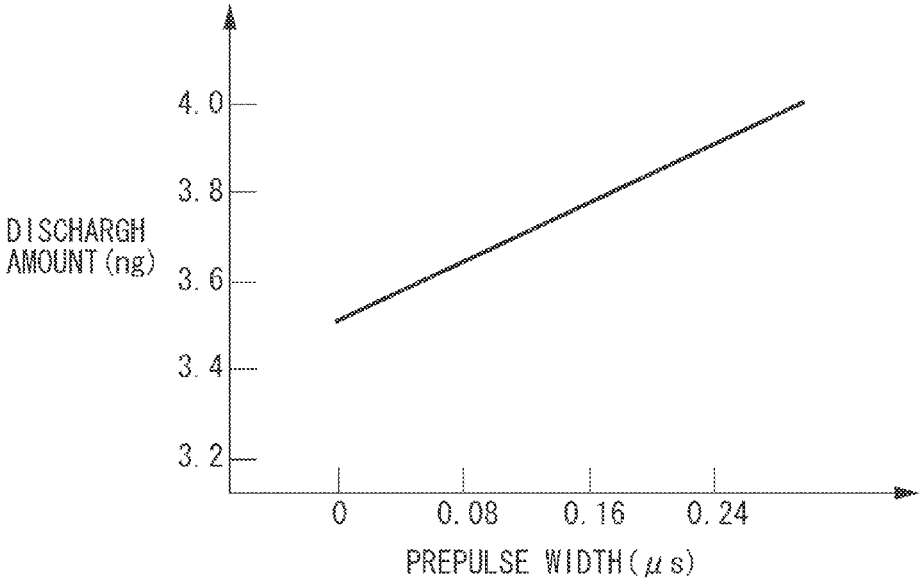

FIG. 4B is a graph illustrating a relationship between the prepulse and the discharge amount of the ink when the interval time P2 and the drive voltage are fixed. It is found that as the pulse width P1 of the prepulse increases, the discharge amount Vd of the ink is also proportionally increased. As the energy amount applied by the prepulse increases, the temperature of the ink rises, and thereby the viscosity of the ink is reduced. When the main pulse is applied in a state where the viscosity of the ink decreases, the discharge amount of the ink increases. Adversely, when the main pulse is applied in a state where the viscosity of the ink does not decrease so much, the discharge amount of the ink increases. In other words, the discharge amount of the ink is adjusted to be almost constant by changing the pulse width of the prepulse, so that the discharge amount control can be performed.

Figure 5B:
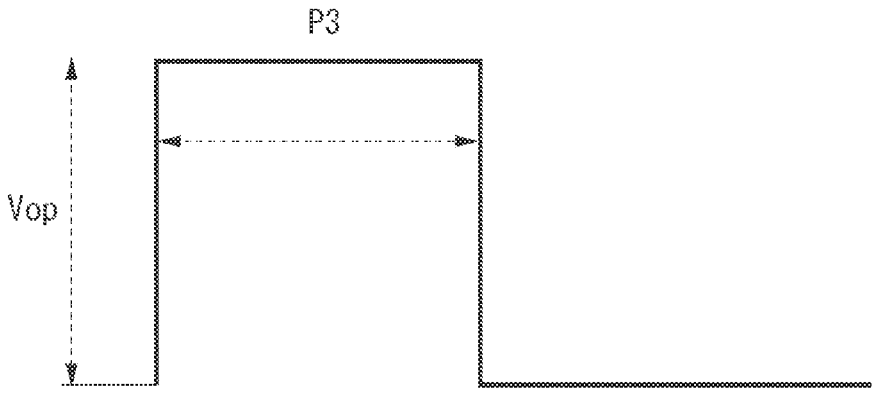

The discharge amount may be varied between a state where the pulse width P1 of the prepulse is 0, as a single pulse illustrated in FIG. 5B and a state where the pulse width P1 is equal to or less than the energy amount causing the ink to prefoam by adjusting the pulse width P1 of the prepulse. In other words, in the range, the discharge amount control can be performed by varying the pulse width P1 when the temperature of the recording head fluctuates the influence of the heat storage caused by the recording operation and an environmental temperature.

Figure 6:
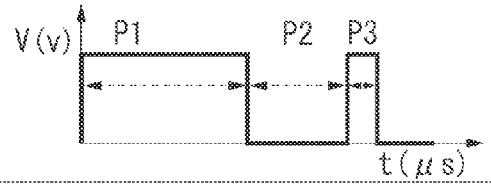
FIG. 6 illustrates waveforms of a plurality of drive pulses used for an discharge amount control of the present invention.
Figure 6:
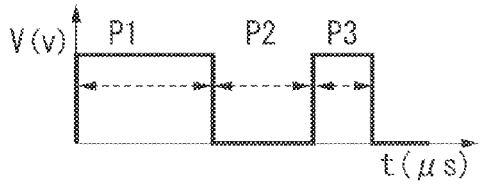
Figure 6:
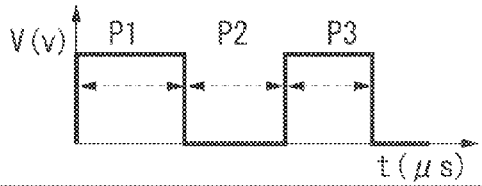
Figure 6:
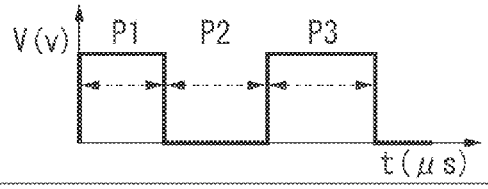
Figure 6:
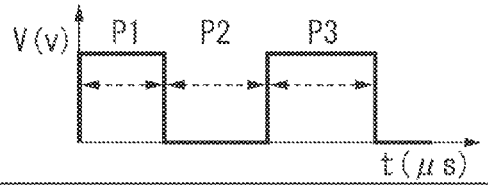
Figure 6:
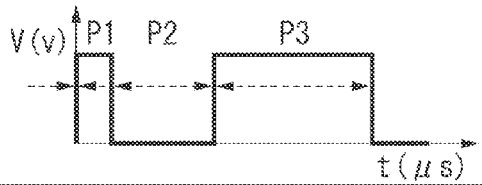
Figure 6:
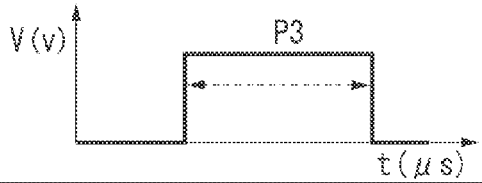

FIG. 6 illustrates a plurality of kinds of drive pulses in which the prepulse widths stored in the drive pulse table in the present invention are mutually different. The drive pulse table includes a drive pulse which is not used so that the prefoaming phenomenon does not arise even in any state in conventional control. The drive pulse can also include the drive pulse in which the width of the prepulse is greater than that of the main pulse as illustrated in Nos. 0, 1, and 2, for example.

Figure 7A:
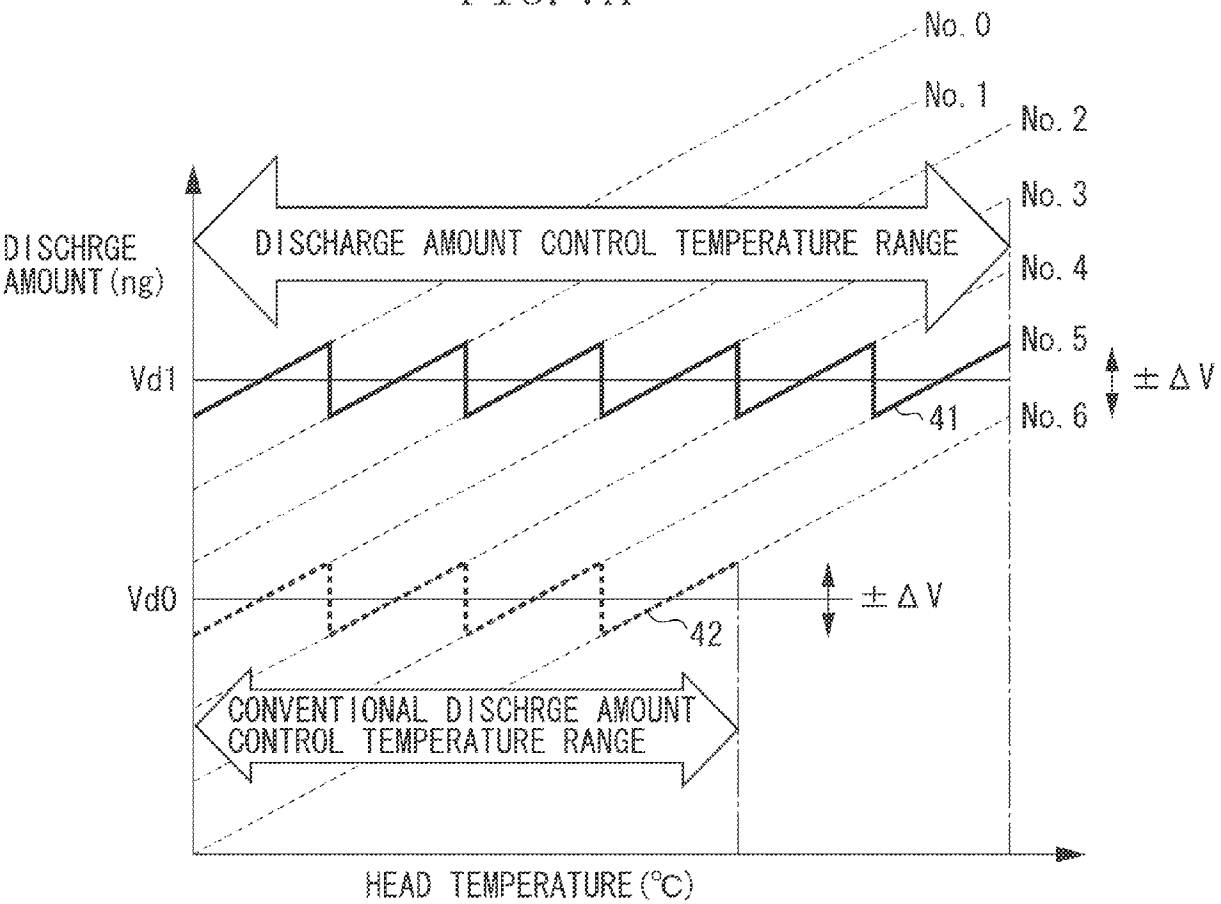
FIGS. 7A and 7B illustrate discharge amount control temperature ranges in the present invention and a conventional technique.

FIG. 7A illustrates a curve 41 of the discharge amount of the ink when the discharge control is performed using the drive pulse table of the present invention and a curve 42 of the discharge amount of the ink when the discharge control is performed using a conventional drive pulse table. It is found that the discharge amount control can be performed to accommodate the discharge amount of the ink within a constant range (Vd1±ΔV) in a temperature range larger than a conventional temperature range in which the discharge amount control can be performed with the discharge amount of the ink set to be within a constant range (Vd0±ΔV), by using the above described drive pulse table. In other words, the number of the drive pulses which can be used in the discharge control can be increased by using also the prepulse of the pulse width which is not conventionally used so that the prefoaming is not caused in any condition.

Figure 7B:
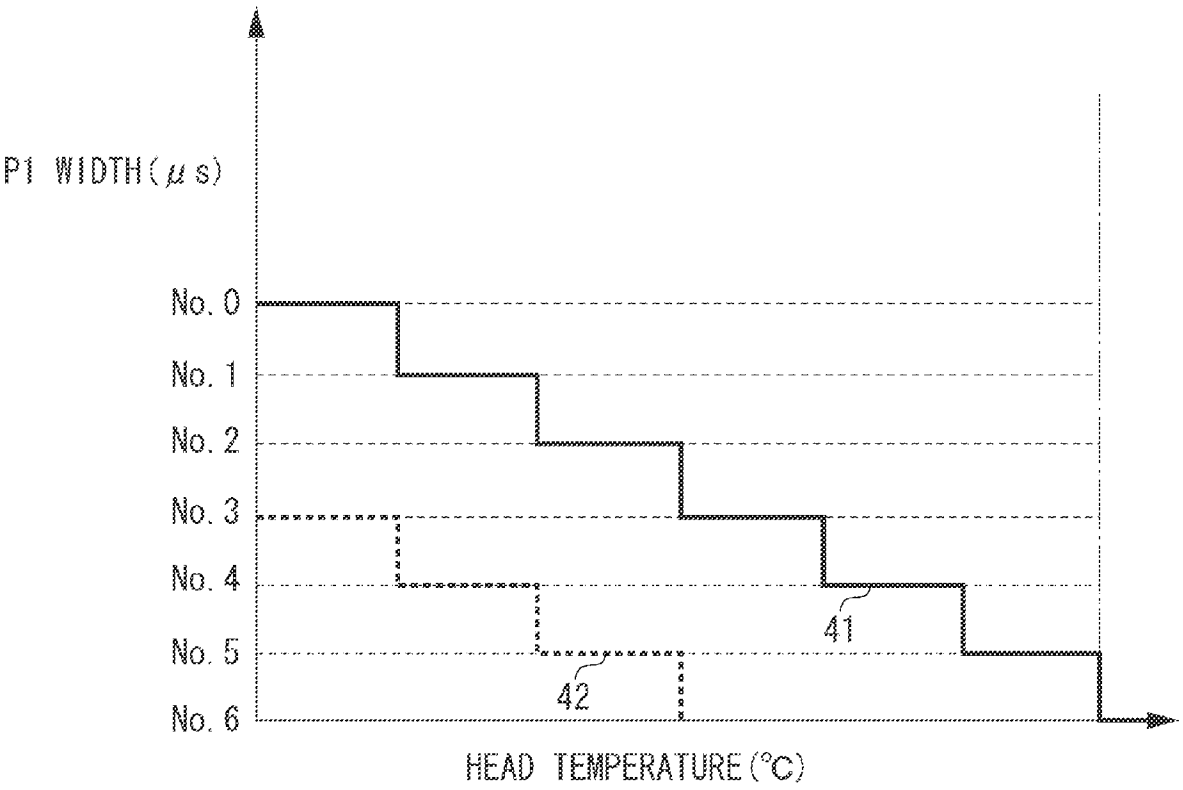

Thereby, a discharge amount control temperature range in which the discharge amount of the ink can be kept within a constant range can be widened. Even if speedup of recording and high density of the discharge port progress, the generation of density unevenness of the recorded image caused by the variation of the discharge amount of the ink caused by temperature fluctuation can be prevented in a large temperature range. Although the target discharge amount is different from that of conventional control, this can be adjusted by changing the shape of the discharge port or a liquid chamber, and the size of a heater. In FIG. 7B, the head temperature in the state of FIG. 7A and the pulse width of the prepulse are plotted. From FIG. 7B, it is found that control is performed so as to use the drive pulse in which the pulse width of the prepulse is short when the head temperature rises, and control is performed so as to use the drive pulse in which the pulse width of the prepulse is large when the temperature of the recording head decreases.

The pulse width of the prepulse of the drive pulse needs to be the drive pulse of the pulse width which does not cause prefoaming so that the ink does not minutely foam when the prepulse is applied. However, a boundary energy amount starting the prefoaming easily fluctuates under the influence of the temperature variation of the recording head, and the fluctuation with time of the discharge characteristic of the recording head, or the like. Therefore, when the discharge control is performed using the drive pulse table including the drive pulse in which the maximum value of the pulse width of the prepulse is larger than a conventional one, to perform the recording operation, there is concern that the recording operation exceeds the boundary energy amount depending on the circumstances to cause the ink to prefoam.

The present invention obtains, before starting the recording operation, a minimum energy amount by which the ink is discharged, and controls, during the recording operation, the drive pulse applied to the energy generation element 34 based on the energy amount and the temperature of the recording head 5. A reliable inkjet recording apparatus can be provided, which can widen a discharge control temperature range in which the discharge amount of the ink can be kept within a constant range by performing the control, and can prevent discharge failure of the ink caused by the prefoaming.

Hereinafter, the control will be specifically described.

A first exemplary embodiment will be described. In the present exemplary embodiment, control for selecting a drive pulse table based on a minimum energy amount by which ink is discharged to prevent discharge failure of the ink caused by prefoaming will be described.

First, a minimum pulse width (hereinafter, also referred to as a threshold value) producing the prefoaming is obtained, and is stored in a storing unit such as a RAM. The threshold value is measured at a timing other than a recording operation such as immediately after turning on a power supply of the apparatus, after performing a plurality of recordings, or after performing a discharge operation of the predetermined number of times.

Here, the reason why the threshold value varies with time will be briefly described. When the discharge operation of the ink is repeated, the surface of a protection layer 405 made of TaSiN or the like as illustrated in FIG. 2C is oxidized by heat produced by an energy generation element 34, and is dissolved in the ink, and thereby the film thickness of the protection layer 405 decreases. Since thermal conductivity to the ink increases when the film thickness of the protection layer 405 decreases, a heating value per a unit pulse width increases. As a result, the threshold value becomes smaller. In other words, since the threshold value varies with time based on the thickness of the protection film of a heater element, the threshold value can be always set to a suitable value by periodical updating.

The pulse width of the threshold value can be determined by detecting the existence or non-existence of the discharge by means of a detection unit 136 such as an optical sensor provided in the ink jet recording apparatus while gradually shortening a single pulse-shaped drive pulse to the energy generation element 34.

Figure 8:
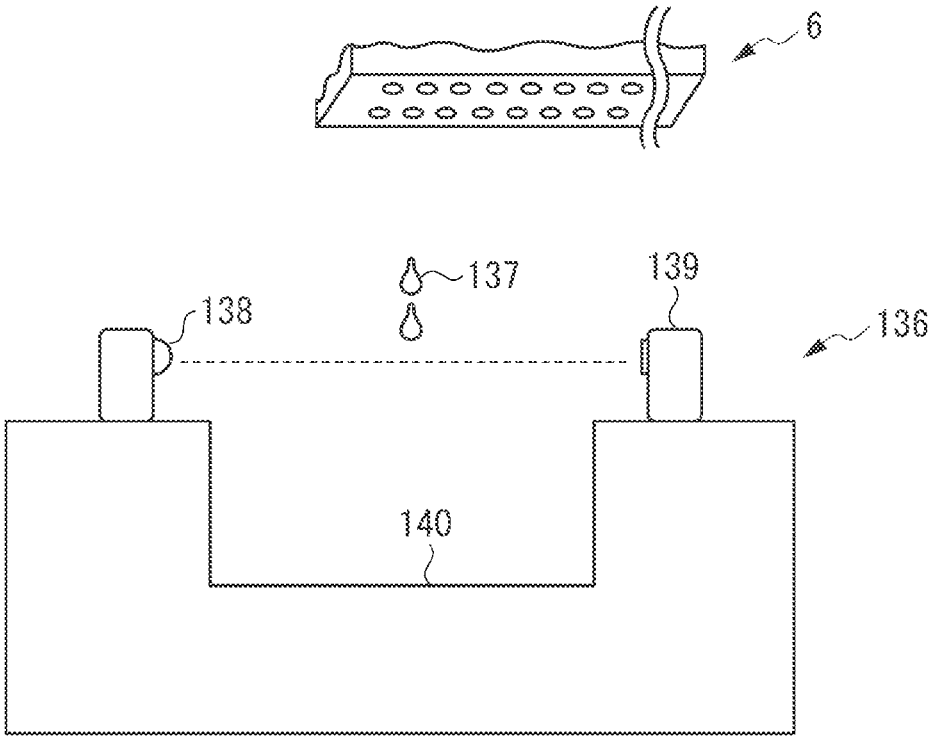
FIG. 8 illustrates an example of a measuring unit configured to measure a threshold value.

A schematic view of an example of the detection unit 136 is illustrated in FIG. 8. The detection unit 136 includes a light emitting portion 138 configured to radiate light, a light receiving portion 139 configured to receive the radiated light, and a liquid storage portion 140. The detection unit 136 is provided in a region in which the operation of a carriage 1 is not inhibited. An operation for detecting the discharge of the ink from a discharge port is performed by moving a recording head 5 to an opposite position of the detection unit 136 and discharging the ink. At this time, droplets 137 of the ink are discharged toward the liquid storage portion 140 so that the droplets 137 pass across a line connecting the light emitting portion 138 and the light receiving portion 139.

The detection unit 136 is provided so that the droplets 137 of the ink discharged from a discharge port 30 pass across the line connecting the light emitting portion 138 and the light receiving portion 139. Thereby, it is determined that a light receiving signal varies when light from the light emitting portion 138 is temporarily shut, and the droplets 137 of the ink are discharged. On the other hand, it can be determined that the droplets 137 of the ink are not discharged when the light receiving signal of the light receiving portion 139 does not vary although the discharge operation is performed.

When the threshold value is obtained, it is necessary to perform measurement when the temperature of the recording head 5 is almost the same temperature each time. This is because the discharge condition of the ink varies unless the temperature of the recording head 5 is the same, and a clear threshold value cannot be obtained. Specifically, the threshold value is obtained in a state where the recording head 5 is controlled to a predetermined temperature using a subheater or the like.

Figure 9A:
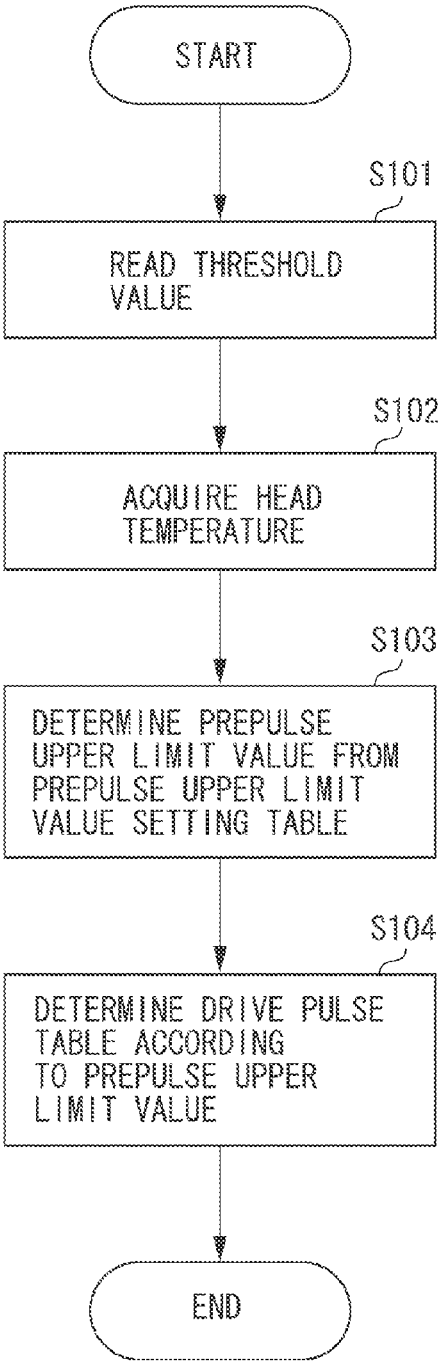
FIGS. 9A and 9B are flow charts illustrating control of a first exemplary embodiment.

Next, control performed at the start of the recording operation when determining the drive pulse table will be described with reference to FIG. 9A. The control for determining the drive pulse table is performed at the start of the recording of the recording medium 4. The control is not changed during the recording operation to a recording medium 4. This is because the discharge amount of the ink varies along the way when the control is changed during the recording operation to the recording medium 4, to cause color irregularities or the like.

First, in step S101, the threshold value preliminarily obtained and stored in the recording medium 4 such as the RAM is read. Next, in step S102, the temperature of the recording head is acquired using a temperature detection sensor 20. Next, in step S103, a prepulse upper limit value at the present recording head temperature is determined with reference to a prepulse upper limit value setting table preliminarily stored in the storage medium such as a ROM and illustrated in FIG. 10A based on the read threshold value and the temperature of the acquired recording head.

A relationship between the threshold value and the prepulse upper limit value at each head temperature is illustrated in the prepulse upper limit value setting table. The prepulse upper limit value of each head temperature is a pulse width immediately before the prefoaming phenomenon of the ink at each head temperature arises. Since the behavior of a pulse width upper limit value of the prepulse to the threshold value by the composition of the ink or solvent formula is different, the prepulse upper limit value setting table is advantageously provided for every ink kind.

Next, drive pulse tables in which all the drive pulses do not exceed the prepulse upper limit value obtained at S103 are selected from a plurality of drive pulse tables stored in the storage medium such as the ROM. Each of a plurality of drive pulses which can perform the discharge control so that the discharge amount is within a constant range even if the head temperature rises are set in each of the drive pulse tables. A temperature range in which the discharge amount can be controlled can be extended by selecting the drive pulse table of the pulse width of the maximum prepulse in which all the drive pulses do not exceed the prepulse upper limit value, of the plurality of prepared drive pulse tables.

Figure 10B:
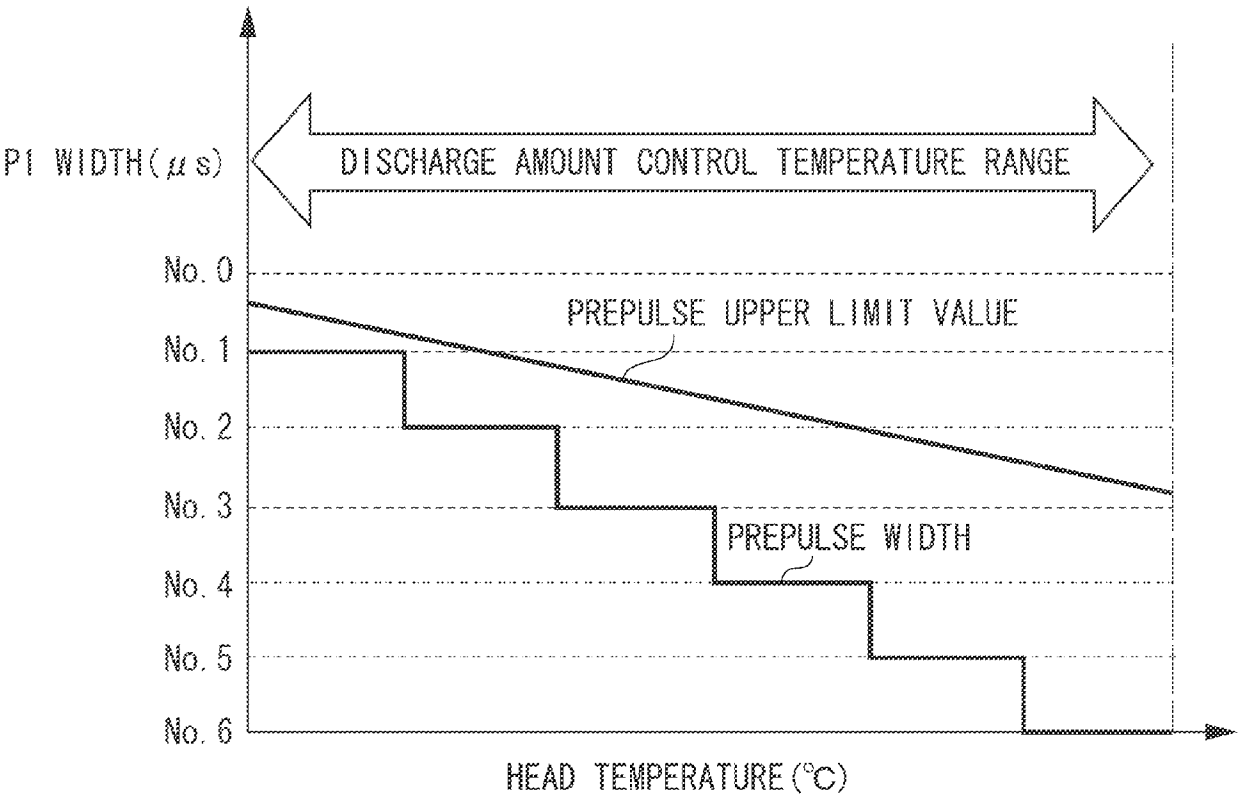

Specifically, the decrease amount of the pulse width upper limit value of the prepulse when the head temperature rises is smaller than the decrease amount of the prepulse width for controlling the discharge amount so that the discharge amount of the ink is constant, as illustrated in FIG. 10B. Furthermore, when the recording operation is started, the temperature of the recording head usually rises compared with that before the recording operation is started. Therefore, it is advantageous to select the drive pulse table in which the prepulse width of the drive pulse at temperatures close to the temperature of the recording head before the recording operation acquired at S102 is closest to the prepulse upper limit value. The temperature range in which all the drive pulses do not exceed the prepulse upper limit value and the discharge amount can be controlled can be maximized by selecting the drive pulse table thus.

An example when the drive pulse table is selected will be described. Suppose that the preliminarily measured threshold value of the recording head is 0.45 μs, and the temperature of the recording head when the recording operation is started is 33° C. It is found that the prepulse upper limit value at this time is 0.44 μs from the prepulse upper limit value setting table of FIG. 10A. It is found that the drive pulse in which the pulse width of the prepulse is equal to or less than 0.44 μs when the temperature of the recording head is 33° C., and the discharge amount is the most is the drive pulse of No. 1 of the pulse width P1=0.40 μs of the prepulse illustrated in FIG. 6. Since a drive pulse of No. 0 (P1=0.48 μs) illustrated in FIG. 6 has a risk of causing the prefoaming phenomenon at temperatures close to the head temperature of 35° C., the drive pulse cannot be used in the situation. Therefore, in such a case, a drive pulse table <1> illustrated in FIG. 10C is selected.

When the threshold value is 0.45 μs and the temperature in the case where the recording operation is started is 43° C., a discharge control table <2> is selected, in which the pulse width of the prepulse is equal to or less than 0.38 μs and a drive pulse of No. 2 illustrated in FIG. 6 is selected within a range of 40° C. or greater and less than 45° C.

When the threshold value is 0.45 μs and the temperature in the case where the recording operation is started is 53° C., a discharge control table <3> is selected, in which the pulse width of the prepulse is equal to or less than 0.32 μs and a drive pulse of No. 3 illustrated in FIG. 6 is selected within a range of 50° C. or greater and less than 55° C.

Figure 9B:
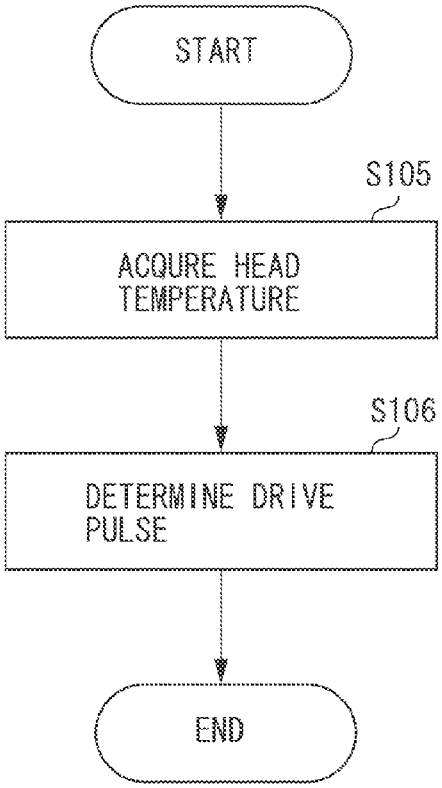

Next, discharge amount control performed during the recording operation will be described with reference to FIG. 9B. The operation is suitably performed during the recording operation.

First, in step S105, the temperature of the recording head is acquired using the temperature detection sensor 20. Next, in step S106, the drive pulse is determined based on the head temperature during the recording operation with reference to a discharge amount control setting table selected at S104. When recording operation is performed for one sheet by performing the recording operation using the drive pulse, the recording operation can be performed by the discharge amount falling within a constant range, and thereby the generation of the color irregularities can be prevented.

In other words, the discharge control temperature range in which the discharge amount of the ink can be kept within a constant range can be widened by performing the control described in the present exemplary embodiment, and the recording operation preventing the discharge failure of the ink caused by the prefoaming can be performed.

A second exemplary embodiment will be described. In the present exemplary embodiment, control for changing a drive pulse based on a minimum energy amount by which ink is discharged, to prevent discharge failure of the ink caused by prefoaming will be described. A timing and a method for acquiring a threshold value are the same as those of the first exemplary embodiment, and the description of the timing and the method are omitted.

Figure 11:
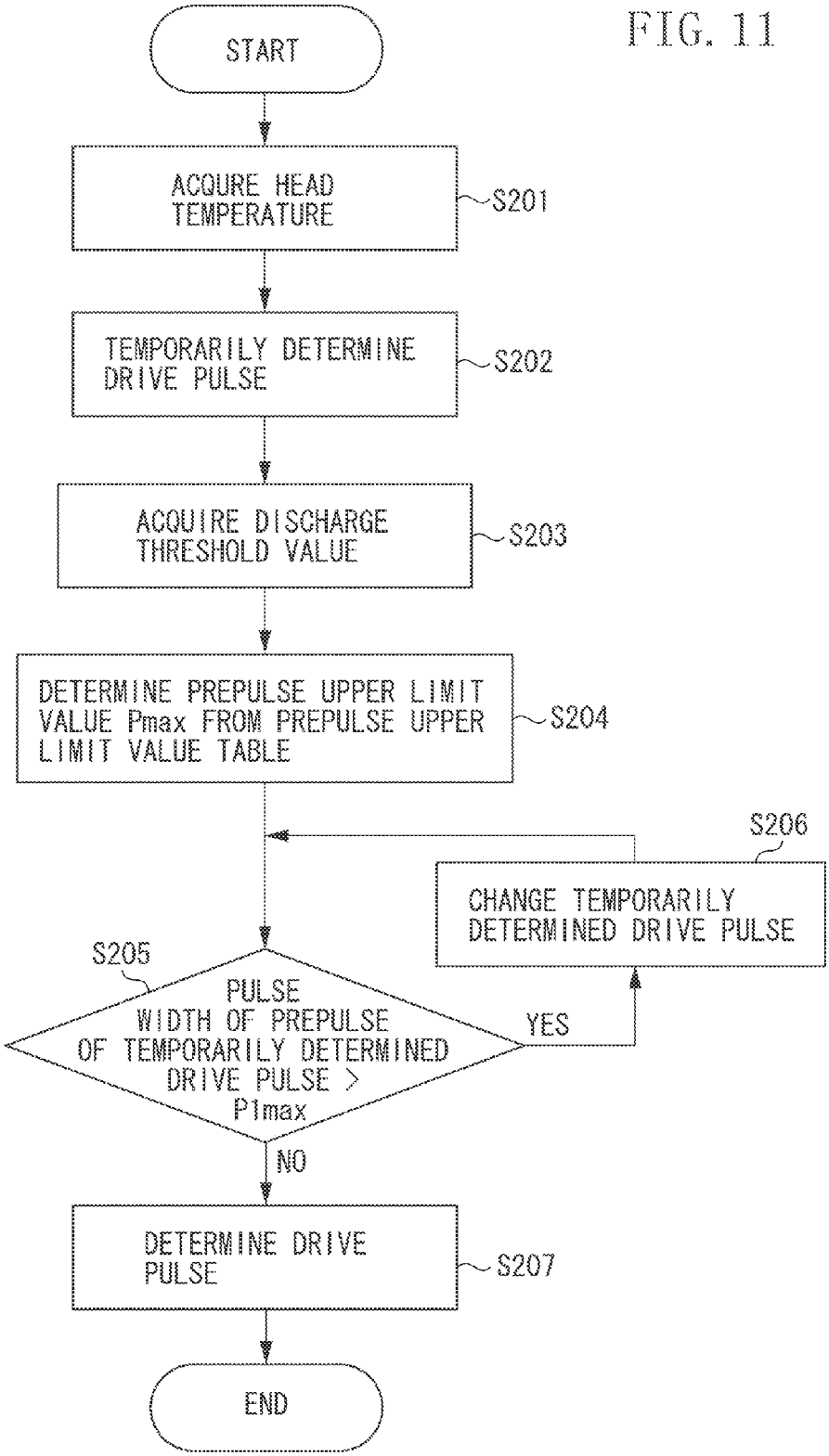
FIG. 11 is a flow chart of control of a second exemplary embodiment.

Control when changing the drive pulse will be described using a flow chart of FIG. 11. The control for changing the drive pulse is executed at each drive pulse setting timing during a recording operation. For example, the control is processing performed for every 48 ms during the recording operation.

First, in step S201, a temperature of a recording head is acquired using a temperature detection sensor 20. Next, in step S202, a drive pulse applied to an energy generation element 34 based on the temperature of the recording head measured is step S201 from a drive pulse table having a plurality of drive pulses illustrated in FIG. 6 is temporarily determined. Here, drive pulses of Nos. 0, 1 and 2 which have a risk of causing a prefoaming phenomenon and are not conventionally set can be also selected. Therefore, the temporarily determined drive pulse may cause prefoaming under the influence of the temperature variation of the recording head caused by fluctuation or the like of an environmental temperature and the fluctuation with time of the discharge characteristic of the recording head, or the like.

Next, in step S203, a threshold value preliminarily obtained and stored in a recording medium 4 such as a RAM is read.

Next, a prepulse upper limit value (P1max) of the present temperature of the recording head is determined with reference to a prepulse upper limit value setting table preliminarily stored in a storage medium such as a ROM and illustrated in FIG. 10A based on the read threshold value and the acquired temperature of the recording head (S204).

A relationship between the threshold value and the prepulse upper limit value at each head temperature is illustrated in the prepulse upper limit value setting table. The prepulse upper limit value at each head temperature is a pulse width immediately before the prefoaming phenomenon arises at each head temperature. Since the behavior of a pulse width upper limit value of the prepulse to the threshold value is different depending on the composition of the ink or solvent recipe, the prepulse upper limit value setting table is advantageously provided for every ink kind.

Next, in step S205, the pulse width of the prepulse in the drive pulse temporarily determined in step S202 and the prepulse upper limit value (P1max) determined in step S204 are compared with each other. Since there is no risk of generation of the prefoaming phenomenon when the prepulse upper limit value is greater than the pulse width of the prepulse in the preliminarily determined drive pulse (No in step S205), in step S207, the temporarily determined drive pulse is determined as the drive pulse as it is.

On the other hand, since there is a risk of generation of the prefoaming phenomenon when the prepulse upper limit value (P1max) is smaller than the pulse width of the prepulse of the preliminarily determined drive pulse (Yes in step S205), in step S206 the temporarily determined drive pulse is changed to a drive pulse in which the pulse width of the prepulse is small. Specifically, the drive pulse is changed to a drive pulse selected in a temperature region of one step higher in the same drive pulse table, and thereby the drive pulse can be changed to a drive pulse in which the pulse width of the prepulse is narrow. When the prepulse width of the changed drive pulse is greater than the prepulse upper limit value (P1max), the changed drive pulse is changed to a drive pulse again, and the drive pulse is changed until the pulse width is greater than the prepulse upper limit value. When the upper limit value of the prepulse is greater than the pulse width of the prepulse in the changed drive pulse, in step S207, the changed drive pulse is determined as the drive pulse.

According to the above control, the discharge failure of the ink caused by the prefoaming can be prevented while the drive pulse table configured to widen a discharge control temperature range is used.

A third exemplary embodiment will be described. The third exemplary embodiment is a method for setting a prepulse upper limit value obtained in the first exemplary embodiment and the second exemplary embodiment with a high degree of accuracy. The method can be applied when the prepulse upper limit value of the first exemplary embodiment or the second exemplary embodiment is determined.

When a recording operation is performed for a long period of time, a material such as a color material or an additive agent in some inks may be decomposed on the surface of a protection layer 405 of FIG. 2C by high-temperature heating. The material may be changed to a hardly soluble material, which may be deposited on a heat-acting portion to the ink of the surface of the protection layer 405. Since a heat transfer characteristic of the heat generated by an energy generation element 34 decreases when the foreign substance is deposited on the heat-acting portion, the attained temperature of the ink when the same pulse width is applied tends to decrease. In other words, since a heating value per a unit pulse width decreases, discharge efficiency decreases. In such a case, the threshold value of a recording head may vary in a direction in which the threshold value increases. An actual threshold value may vary in a direction in which the threshold value decreases compared with the case where the threshold value is measured by the reduction in the film thickness of the protection layer 405 described in the first exemplary embodiment after the lapse of a long period of time after the threshold value is measured.

In other words, a state of a suitable prepulse upper limit value is said to always vary according to the number of times of the recording operation, specifically, the discharge number of the ink. However, since a certain amount of detection time is required for the detection of the threshold value described in the first exemplary embodiment, a longer time is required for the recording operation when the detection is frequently performed.

In the present exemplary embodiment, the prepulse upper limit value in consideration of the fluctuation of the threshold value during recording is set by weighting the prepulse upper limit value according to the accumulated discharge number counted from the point at which the threshold value is detected.

Figure 12A:
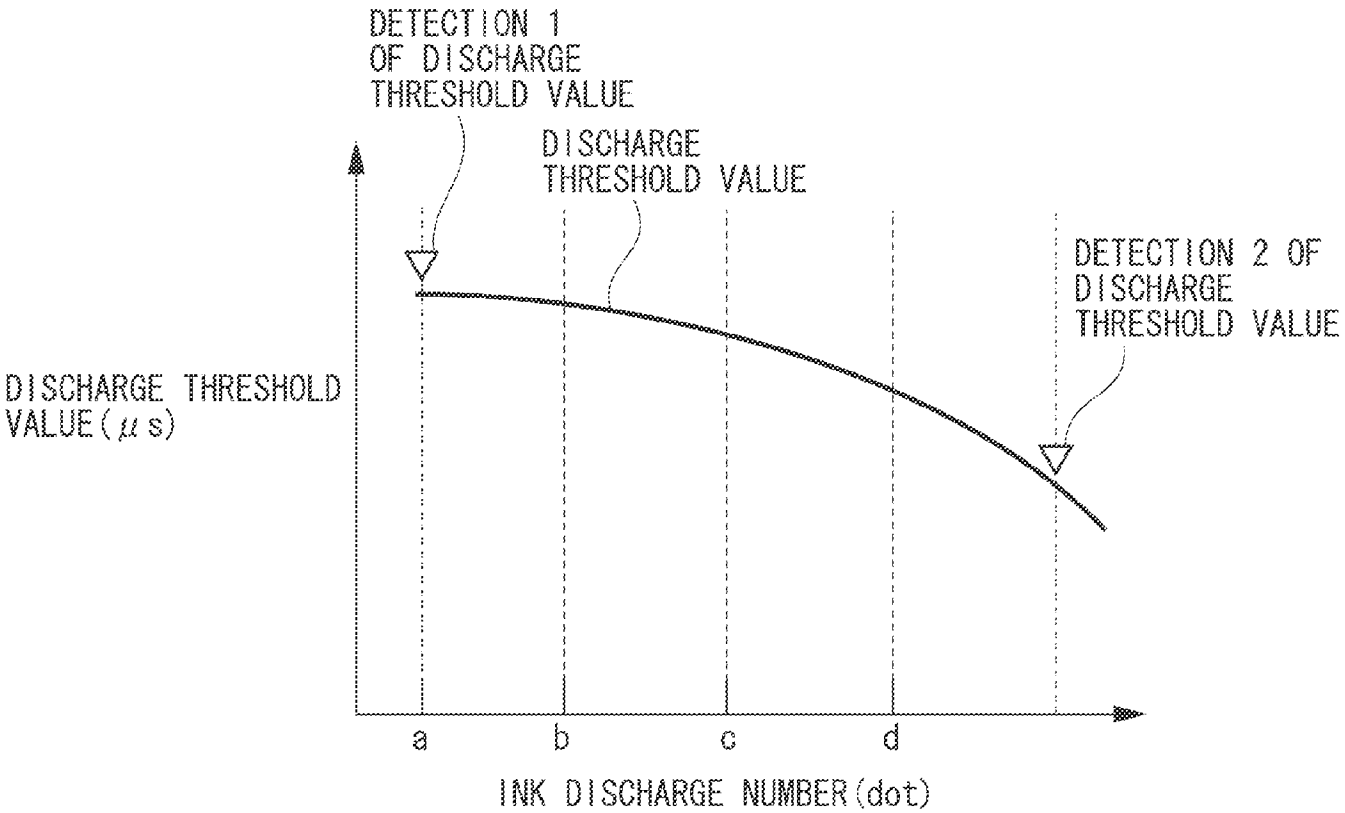

FIG. 12A is a graph illustrating a variation in the threshold value to the discharge number of the ink. The variation in the threshold value illustrated in the graph is an example of a certain ink and a certain recording head, and is determined by the characteristic of the ink and the state of the recording head. Detection 1 of the threshold value and detection 2 of the threshold value illustrate a timing at which the threshold value is detected. Thus, when the threshold value fluctuates between the timings of the detections of the threshold values, the prepulse upper limit value is said to need to be determined by adding the fluctuation of the threshold value.

First, an interval between the detection 1 of the threshold value and the detection 2 of the threshold value is divided into a plurality of timings. Here, a case where the threshold value is detected every 4E+7 times and the interval between the detection 1 of the threshold value and the detection 2 of the threshold value is divided into for intervals illustrated as an example. The accumulated discharge number 0 from the timing of the detection 1 of the threshold value is defined as a timing of the discharge number a. The accumulated discharge number 1E+7 times is defined as a timing of the discharge number b. The accumulated discharge number 2E+7 times is defined as a timing of the discharge number c. The accumulated discharge number 3E+7 times is defined as a timing of the discharge number d.

The variation in the threshold value according to the discharge number at each timing is found out beforehand. A weighting coefficient to the prepulse upper limit value illustrated in FIG. 12C is set. The weighting coefficient is set to a pulse width immediately before a prefoaming phenomenon arises in each discharge number.

Figure 12B:
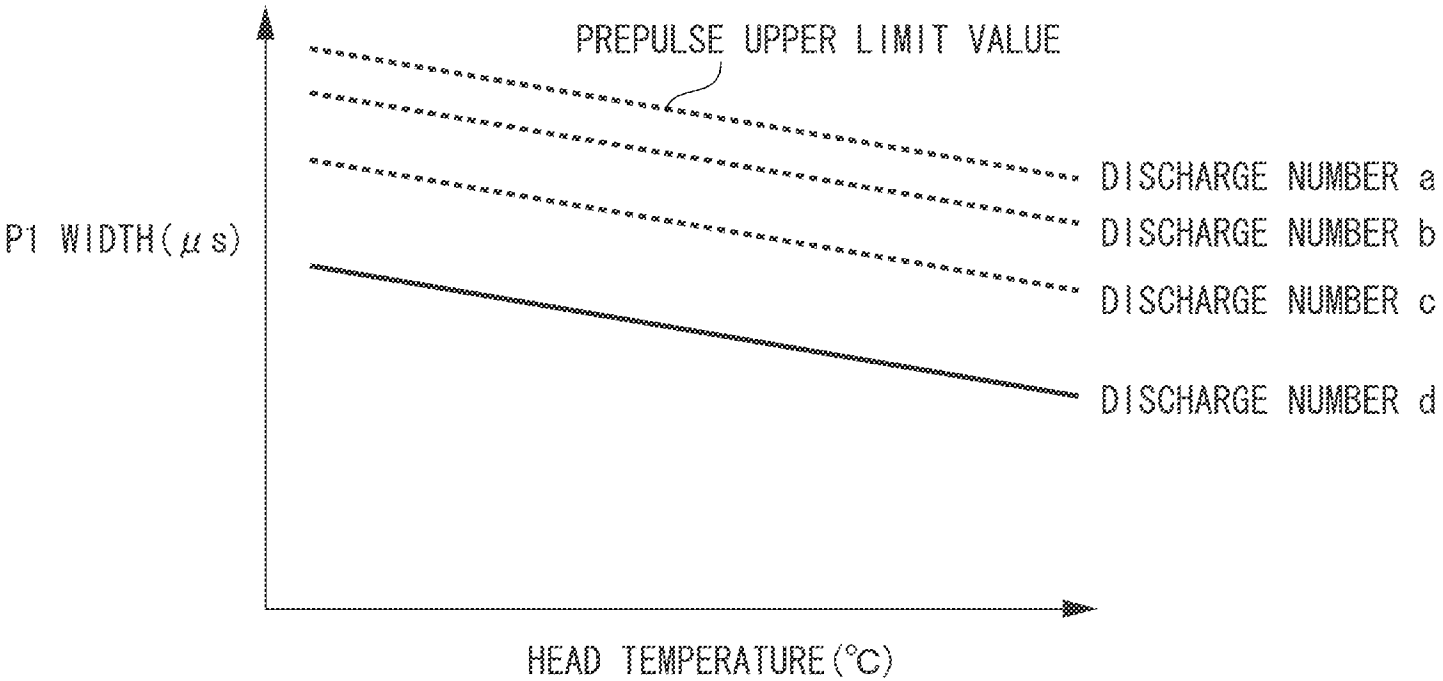

The prepulse upper limit value set in the prepulse upper limit value setting table of FIG. 10 is weighted according to the accumulated discharge number from the time of detecting the threshold value. Thereby, as illustrated in FIG. 12B, the prepulse upper limit value can be brought closer to an actual prepulse upper limit value. Therefore, the discharge failure of the ink caused by prefoaming can be further prevented.

A fourth exemplary embodiment will be described. The fourth exemplary embodiment is a method for setting the prepulse upper limit value obtained in the first exemplary embodiment and the second exemplary embodiment with a high degree of accuracy in the same manner as in the third exemplary embodiment. The method can be applied when the prepulse upper limit value of the first exemplary embodiment or the second exemplary embodiment is determined.

As illustrated in FIG. 2A, four discharge port rows are provided, which include 640 discharge ports arranged at a pitch of 600 dpi (dot/inch) in a recording head 5. The two adjacent rows are arranged in a direction deviated by 1200 dpi. In the present exemplary embodiment, control will be described in a case where a variation in a threshold value produced when a temperature detection sensor 20 is provided on both ends of the discharge port row is added.

When a recording operation is performed in the recording head having the discharge port rows illustrated in FIG. 2A, the central portion of the discharge port row may become a higher temperature state than those of both end portions thereof. This is because the central portion of the discharge port row has a poorer heat dissipation characteristic than those of both the end portions, and is likely to accumulate heat. Since the temperature detection sensor 20 is located on the end portion of the discharge port row in such a case, an actual temperature of the vicinity of the discharge port of the central portion cannot be acquired.

The temperature variation of the discharge port which cannot be detected by the head temperature detection sensor 20 is predicted by weighting the set prepulse upper limit value according to a duty of recorded image data in the present exemplary embodiment, and is reflected in the prepulse upper limit value. A recording duty is a ratio of the number of pixels of a recorded image to the total number of pixels in a certain region.

Figure 13A:
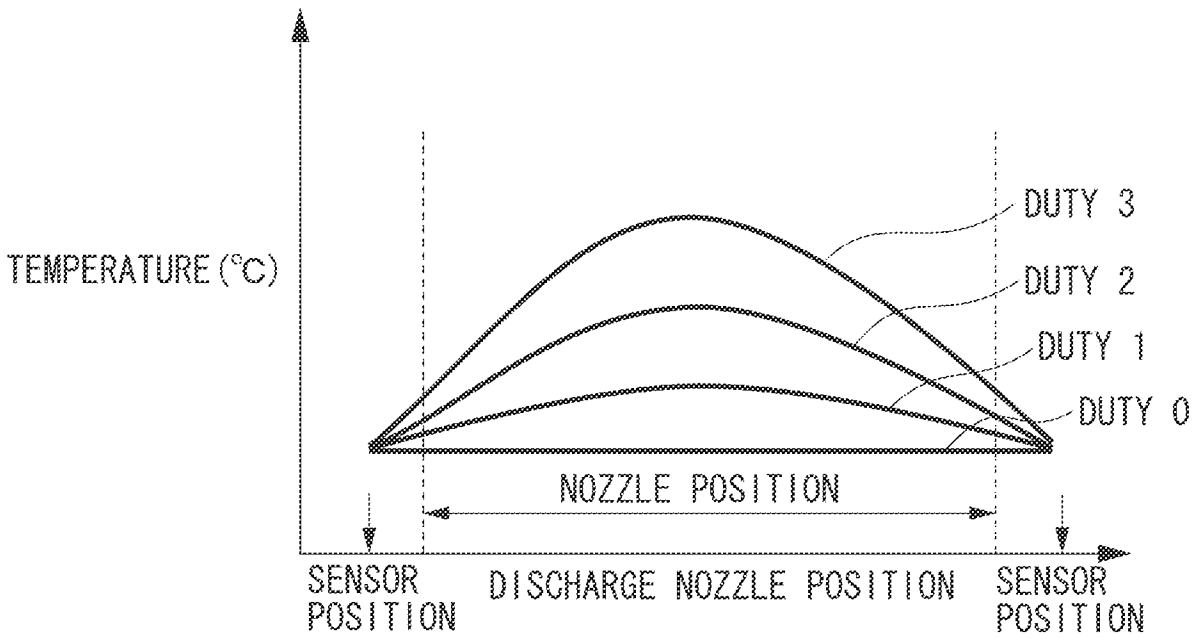
FIGS. 13A, 13B, and 13C illustrate control of a fourth exemplary embodiment.

FIG. 13A is a graph illustrating an attained temperature for every position of the discharge port row when images of a plurality of duties are recorded. A duty 0, a duty 1, a duty 2, and a duty 3 in FIG. 13A illustrate attained temperatures for every position of the discharge port when the recording duty is 20%, 40%, 60%, and 80% respectively. As the recording duty is higher, a great difference occurs between the maximum attained temperature of the discharge port row and the detection temperature of the head temperature detection sensor 20. A prefoaming phenomenon is apt to arise in the central portion of the discharge port compared with both the end portions thereof. Therefore, when the control of the present exemplary embodiment is not performed, it is necessary to set a prepulse upper limit value setting table in consideration of the temperature variation of the discharge port which cannot be detected by the temperature detection sensor 20. Therefore, the prepulse upper limit value setting table is provided by adding a state of the recording duty 100% in which the temperature detection sensor 20 and the actual temperature of the discharge port are most deviated from each other. In other words, the prepulse upper limit value setting table corresponding to the duty 3 of FIG. 13B is used.

Figures 13B, 13C:
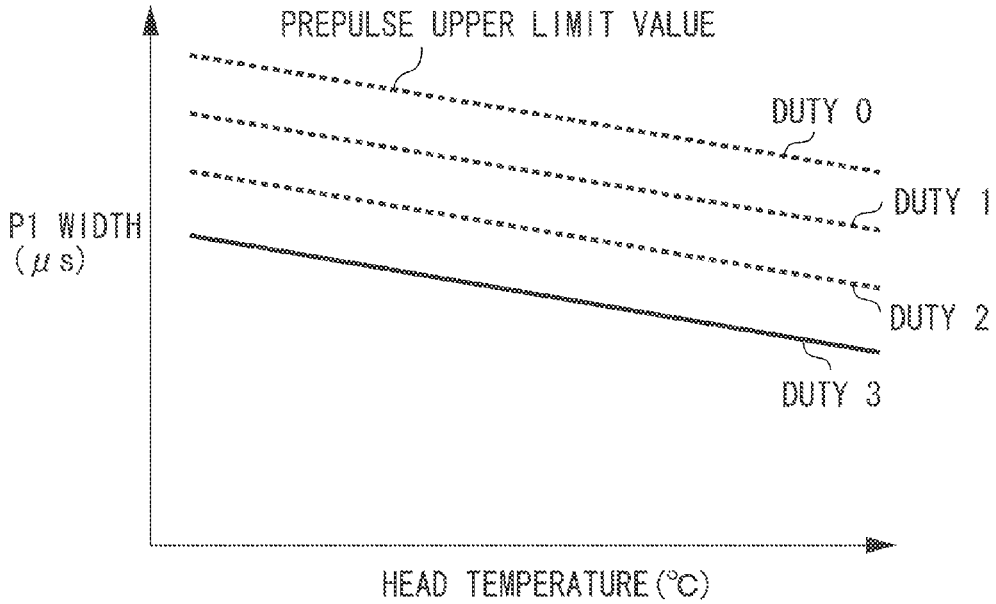

In the present exemplary embodiment, as illustrated in FIG. 13C, a weighting coefficient to the prepulse upper limit value is set according to the recording duty. The attained temperature of the discharge port when various duties at each head temperature are preliminarily recorded is found out beforehand. The weighting coefficient is set to a pulse width immediately before the prefoaming phenomenon arises on each condition. The weighting coefficient may be set according to not only the recording duty but also a discharge frequency and the recording dot number in which the temperature distribution of the discharge port rows can be predicted.

Thus, the prepulse upper limit value is weighted according to the recording duty of the image. Thereby, as illustrated in FIG. 13B, the prepulse upper limit value can be more greatly set, and a discharge amount control range can be further extended.

A fifth exemplary embodiment will be described. The fifth exemplary embodiment will describe a method for setting a prepulse upper limit value without preliminarily providing a prepulse upper limit value setting table of FIG. 10A in a storage medium such as a ROM of a recording apparatus with reference to FIG. 14A. Thereby, a more exact prepulse upper limit value can be set for every ink.

Although the detection of the threshold value described in the first exemplary embodiment is measured at one head temperature, the threshold value is detected at a plurality of head temperatures in the present exemplary embodiment. For example, three points of 30° C., 45° C., and 60° C. are set. A threshold value at each head temperature is calculated based on the threshold value detected at each head temperature. Although a case where the three threshold values are linearly complemented is described in FIG. 14A, the complementing method is not limited thereto.

Ideally, the prepulse upper limit value at each head temperature is desirably set to a pulse width immediately before a prefoaming phenomenon at each temperature arises. However, since an approximate value can be predicted from the threshold value, a value obtained by decreasing the threshold value at each head temperature linearly complemented from the plurality of threshold values by a certain amount may be set as the prepulse upper limit value.

Figure 14A:
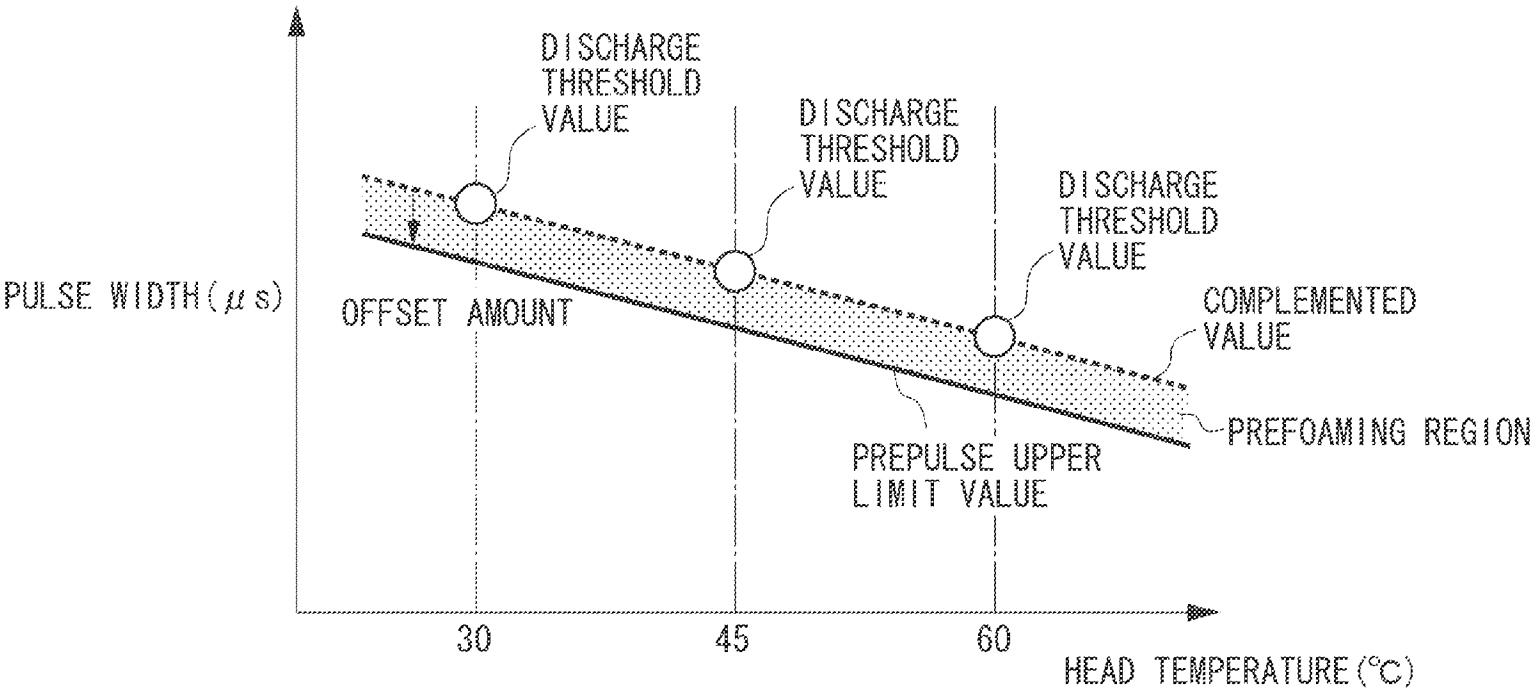

Since a width of a prefoaming region illustrated in FIG. 14A is different for every ink kind even in the same threshold value, as illustrated in FIG. 14B, a width of the threshold value and the prepulse upper limit value can be set by subtracting a certain offset amount from the threshold value for every ink kind. A method for setting the prepulse upper limit value may be set by multiplying the threshold value at each temperature by a certain predetermined coefficient, and is not limited to an offset of a certain amount from the threshold value at each temperature.

Thus, the prepulse upper limit value can be more exactly set compared with the preliminary provision of the prepulse upper limit value setting table illustrated in FIG. 10 by setting the prepulse upper limit value based on the plurality of threshold values measured on the recording apparatus.

Other exemplary embodiment will be described. The first to fifth exemplary embodiments are described using the examples controlling the drive pulse when the discharge amount control is performed in the case where the viscosity of the ink is always constant. However, the present invention can be applied also to the control of the drive pulse when the viscosity of the ink temporarily varies.

When a period (also referred to as a non-discharge time) in which a recording head is not driven for long, the viscosity of ink increases by evaporation of moisture from the surface of a discharge port, to temporarily discharge high viscosity ink. If an energy generation element 34 is driven using the same drive pulse as that when the viscosity of the ink does not increase in the case of the high viscosity ink, the discharge amount of the ink may decrease, or the ink may be in a state where it is not discharged (non-discharge).

Therefore, in this case, control is performed to set only the drive pulse used for a temporary period in which the high viscosity ink is discharged, to a drive pulse in which the pulse width of the prepulse increasing the discharge amount of the ink is great. Thus, the decrease of the discharge amount and non-discharge of the ink caused by the increase of the viscosity of the ink can be prevented by temporarily using the drive pulse in which the pulse width of the prepulse is great.

The drive pulse when the viscosity of the ink increases is also controlled so that the pulse width of the prepulse of the drive pulse applied to the energy generation element 34 is smaller than the prepulse upper limit value as in the first and the second exemplary embodiments 1 and 2. Thereby, the discharge failure of the ink caused by the prefoaming can be prevented.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., a non-transitory computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-272758 filed Dec. 13, 2011, which is hereby incorporated by reference herein in its entirety.

What is claimed is:

1. An ink jet recording apparatus comprising:

a recording head including a plurality of energy generation elements configured to generate thermal energy for discharging ink when a drive pulse is applied thereto;

a temperature detection unit configured to detect a temperature of the recording head;

an acquisition unit configured to acquire a minimum pulse width by which the ink is discharged;

a specification unit configured to specify a pulse width upper limit value of a prepulse of the drive pulse to be applied to the plurality of energy generation elements for a recording operation, wherein the prepulse of the drive pulse is applied to the plurality of energy generation elements prior to an application of a main pulse of the drive pulse to the plurality of energy generation elements, based on the minimum pulse width acquired by the acquisition unit and the temperature, detected by the temperature detection unit, of the recording head during the recording operation; and a control unit configured to control a drive pulse application to the plurality of energy generation elements such that the energy generation elements are driven by the drive pulse of a prepulse with a pulse width equal to or less than the pulse width upper limit value specified by the specifying unit, wherein the control unit selects a drive pulse applied to the energy generation elements from a drive pulse table including a plurality of drive pulses based on the temperature of the recording head detected by the temperature detection unit, changes the drive pulse to a drive pulse in which a pulse width of a prepulse is smaller than the pulse width upper limit value when a pulse width of a prepulse of the selected drive pulse is greater than the pulse width upper limit value, and controls the energy generation elements to be driven using the changed drive pulse.

2. The ink jet recording apparatus according to claim 1, wherein the acquisition unit acquires the minimum pulse width at a timing other than the recording operation.

3. The ink jet recording apparatus according to claim 2, wherein the acquisition unit acquires the minimum pulse width at a timing based on a dot count of a number of ink discharge from the recording head.

4. The ink jet recording apparatus according to claim 1, wherein the acquisition unit acquires the minimum pulse width on a predetermined temperature of the recording head with the recording head kept at a constant temperature.

5. The ink jet recording apparatus according to claim 1, further comprising:

a count unit configured to count the discharge a number of ink discharge from the recording head after specifying the pulse width upper limit value is specified by the specification unit; and an adjustment unit configured to adjust the pulse width upper limit value according to the accumulated discharge number counted by the count unit, wherein the control unit determines a drive pulse applied to the energy generation elements using the adjusted pulse width upper limit value.

6. The ink jet recording apparatus according to claim 1, wherein the control unit adjusts the pulse width upper limit value according to a recording duty of an image recorded by the recording head, determines a drive pulse applied to the energy generation elements using the adjusted pulse width upper limit value, and controls the drive pulse application to the plurality of energy generation elements such that the energy generation elements are to be driven using the determined drive pulse.

7. The ink jet recording apparatus according to claim 1, further comprising a setting unit configured to provide a relationship between a plurality of threshold values and the temperature of the recording head based on the minimum pulse width at each temperature measured with the recording head controlled to a plurality of mutually different temperatures, wherein the specification unit specifies the pulse width upper limit value of the prepulse based on the relationship provided by the setting unit.

8. An ink jet recording apparatus comprising:

a recording head including a plurality of energy generation elements configured to generate thermal energy for discharging ink when a drive pulse is applied thereto;

a temperature detection unit configured to detect a temperature of the recording head;

an acquisition unit configured to acquire a minimum pulse width, by which the ink is discharged, on a predetermined temperature of the recording head by executing an operation relating the measurement of the minimum pulse width;

an obtaining unit configured to obtain information relating to each of a plurality of minimum pulse widths, by which the ink is discharged, for a different one of a plurality of temperatures;

a determining unit configured to determine a prepulse of the drive pulse to be applied to the plurality of energy generation elements for a recording operation based on the minimum pulse width on the predetermined temperature of the recording head acquired by the acquisition unit, information stored in the storing unit, and the temperature of the recording head during the recording operation detected by the temperature detection unit, wherein the prepulse of the drive pulse is applied to the plurality of energy generation elements prior to an application of a main pulse of the drive pulse; and a control unit configured to control a drive pulse application to the plurality of energy generation elements, wherein the energy generation elements are driven by the drive pulse of a prepulse with a pulse width determined by the determining unit.

9. An ink jet recording apparatus for recording an image on a recording medium comprising:

a recording head including a plurality of energy generation elements for ejecting ink when a driving pulse is applied thereto;

a first obtaining unit configured to obtain information regarding a minimum pulse among a plurality of driving pulses which causes ejection of ink by being applied to the energy generation elements before start of recording of an image;

a first determining unit configured to determine an upper limit value of a pulse width of a prepulse to be applied to the plurality of energy generation elements for the recording based on the minimum pulse indicated by the information obtained by the first obtaining unit before the start of the recording;

a second determining unit configured to determine a driving pulse table among candidates of driving pulse tables based on the upper limit value of the pulse width of the prepulse determined by the first determining unit before the start of the recording, wherein each of the candidates of driving pulse tables includes a plurality of driving pulses, each of the plurality of driving pulses comprising a main pulse and a prepulse, each prepulse having a different pulse width a second obtaining unit configured to obtain information regarding a temperature of the recording head during the recording;

a third determining unit configured to determine a driving pulse among the plurality of driving pulses in the driving pulse table determined by the second determining unit based on the temperature indicated by the information obtained by the second obtaining unit during the recording; and a controlling unit configured to control ejecting ink by applying the driving pulse determined by the third determining unit to the plurality of energy generation elements.

10. The ink jet recording apparatus according to claim 9, further comprising:

a third obtaining unit configured to obtain information regarding a temperature of the recording head before the start of the recording, wherein the first determining unit determines the upper limit value of the pulse width of the prepulse based on the minimum pulse indicated by the information obtained by the first obtaining unit and the temperature indicated by the information obtained by the third obtaining unit before start of printing.

11. The ink jet recording apparatus according to claim 10, wherein the first determining unit determines the upper limit value of the pulse width of the prepulse such that an upper limit value in a case that the temperature indicated by the information obtained by the third obtaining unit is a first temperature is larger than an upper limit value in a case that the temperature indicated by the information obtained by the third obtaining unit is a second temperature which is higher than the first temperature.

12. The ink jet recording apparatus according to claim 9, wherein the second determining unit determines the driving pulse table such that a pulse width of a prepulse of a first driving pulse is shorter than the upper limit value of the prepulse determined by the first determining unit before the start of the recording, wherein the first driving pulse is a driving pulse having the longest pulse width of a prepulse among the plurality of the driving pulses in a same driving pulse table.

13. The ink jet recording apparatus according to claim 12, wherein the second determining unit determines the driving pulse table such that a difference between the pulse width of the prepulse of the first driving pulse and the upper limit value of the prepulse determined by the first determining unit is the smallest among the candidates of driving pulse tables.

14. The ink jet recording apparatus according to claim 9, wherein the first determining unit determines the upper limit value of the pulse width of the prepulse such that an upper limit value in a case that the pulse width of the minimum pulse indicated by the information obtained by the first obtaining unit is a first width is smaller than an upper limit value in a case that the pulse width of the minimum pulse indicated by the information obtained by the first obtaining unit is a second width which is larger than the first width.

15. The ink jet recording apparatus according to claim 9, wherein the third determining unit determines the driving pulse such that a pulse width of the prepulse of the driving pulse in a case that the temperature indicated by the information obtained by the second obtaining unit is a third temperature is longer than an pulse width of the prepulse of the driving pulse in a case that the temperature indicated by the information obtained by the second obtaining unit is a fourth temperature which is higher than the third temperature.

16. The ink jet recording apparatus according to claim 9, wherein the first obtaining unit obtains information regarding the minimum pulse based on a count of a number of ink discharge from the recording head.

17. An ink jet recording apparatus for recording an image on a recording medium comprising:

a recording head including a plurality of energy generation elements for ejecting ink when a driving pulse is applied thereto;

a memorizing unit configured to memorize information regarding a minimum pulse among a plurality of pulses which causes ejection of ink by being applied to the plurality of energy generation elements before start of recording of an image;

a first obtaining unit configured to obtain information regarding a temperature of the recording head during the recording;

a first determining unit configure to determine a first driving pulse, comprising a main pulse and a prepulse, based on the temperature indicated by the information obtained by the first obtaining unit during the recording;

a second obtaining unit configured to obtain the information regarding the minimum pulse memorized by the memorizing unit during the recording;

a second determining unit configured to determine an upper limit value of the pulse width of a prepulse to be applied to the plurality of energy generation elements for the recording based on the minimum pulse indicated by the information obtained by the second obtaining unit during the recording;

a changing unit configured to change the first driving pulse determined by the first determining unit, in a case that a pulse width of the prepulse of the first driving pulse determined by the first determining unit is longer than the upper limit value of the pulse width of the prepulse determined by the second determining unit, to a second driving pulse, wherein the second drive pulse comprises a main pulse and a prepulse, the prepulse having a shorter pulse width than the pulse width of the prepulse of the first driving pulse; and a controlling unit configured to control ejecting ink, in a case that the pulse width of the prepulse of the first driving pulse determined by the first determining unit is longer than the upper limit value of the pulse width of the prepulse determined by the second determining unit, by applying the second driving pulse changed by the changing unit to the plurality of energy generation elements.

18. The ink jet recording apparatus according to claim 17, wherein the changing unit does not change the first driving pulse determined by the first determining unit, in a case that a pulse width of the prepulse of the first driving pulse determined by the first determining unit is shorter than the upper limit value of the pulse width of the prepulse determined by the second determining unit, and wherein the controlling unit controls ejecting ink, in a case that the pulse width of the prepulse of the first driving pulse determined by the first determining unit is shorter than the upper limit value of the pulse width of the prepulse determined by the second determining unit, by applying the first driving pulse determined by the first determining unit to the plurality of energy generation elements.

19. The ink jet recording apparatus according to claim 18, wherein the second determining unit determines the upper limit value of the pulse width of the prepulse such that an upper limit value in a case that pulse width of the minimum pulse indicated by the information obtained by the second obtaining unit is a first width is smaller than an upper limit value in a case that pulse width of the minimum pulse indicated by the information obtained by the second obtaining unit is a second width which is larger than the first width.

20. The ink jet recording apparatus according to claim 18, wherein the first determining unit determines the first driving pulse such that the pulse width of the prepulse of the first driving pulse in a case that the temperature indicated by the information obtained by the first obtaining unit is a third temperature is longer than the pulse width of the prepulse of the first driving pulse in a case that the temperature indicated by the information obtained by the first obtaining unit is a fourth temperature which is higher than the third temperature.

21. The ink jet recording apparatus according to claim 17, wherein a pulse width of the prepulse of the second driving pulse is shorter than the upper limit value of the pulse width of the prepulse determined by the second determining unit.

22. The ink jet recording apparatus according to claim 17, wherein the memorizing unit memorizes the information regarding the minimum pulse which is obtained based on a count of a number of ink discharge from the recording head.

23. The ink jet recording apparatus according to claim 17, wherein the second determining unit determines the upper limit value of the pulse width of the prepulse based on the minimum pulse indicated by the information obtained by the second obtaining unit and the temperature indicated by the information obtained by the first obtaining unit during the recording.

24. The ink jet recording apparatus according to claim 23, wherein the second determining unit determines the upper limit value of the pulse width of the prepulse such that an upper limit value in a case that the temperature indicated by the information obtained by the first obtaining unit is a first temperature is larger than an upper limit value in a case that the temperature indicated by the information obtained by the first obtaining unit is a second temperature which is higher than the first temperature.

25. An ink jet recording apparatus for recording image on a recording medium comprising:

a recording head including a plurality of energy generation elements for ejecting ink when a driving pulse is applied thereto;

a memorizing unit configured to memorize information regarding a minimum pulse among a plurality of pulses which causes ejection of ink by being applied to the plurality of energy generation elements before start of recording of an image;

a first obtaining unit configured to obtain information regarding a temperature of the recording head during the recording;

a second obtaining unit configured to obtain the information regarding the minimum pulse memorized by the memorizing unit during the recording;

a first determining unit configured to determine an upper limit value of the pulse width of the prepulse to be applied to the plurality of energy generation elements for the recording based on the minimum pulse indicated by the information obtained by the second obtaining unit and the temperature indicated by the information obtained by the first obtaining unit during the recording;

a second determining unit configured to determine a driving pulse, comprising a main pulse and a prepulse, such that a pulse width of the driving pulse is shorter than the upper limit value of the pulse width of the prepulse determined by the first determining unit; and a controlling unit configured to control ejecting ink by applying the driving pulse determined by the second determining unit to the plurality of energy generation elements.

* * * * *